US008651572B2

(12) United States Patent
Medeiros et al.

(10) Patent No.: US 8,651,572 B2
(45) Date of Patent: Feb. 18, 2014

(54) SWIVEL FEEDING SEAT

(75) Inventors: David Medeiros, Plainville, MA (US); Mike Y. Daikubara, Quincy, MA (US); Cindy Fine, Sharon, MA (US); Jorge Tomas, Wrenthan, MA (US)

(73) Assignee: TOMY Holdings, Inc., Oak Brook, IL (US)

( * ) Notice: Subject to any disclaimer, the term of this patent is extended or adjusted under 35 U.S.C. 154(b) by 325 days.

(21) Appl. No.: 12/689,747

(22) Filed: Jan. 19, 2010

(65) Prior Publication Data

US 2010/0181808 A1 Jul. 22, 2010

Related U.S. Application Data

(60) Provisional application No. 61/145,676, filed on Jan. 19, 2009.

(51) Int. Cl.
*A47D 1/00* (2006.01)

(52) U.S. Cl.
USPC ..... 297/256.13; 297/256.1; 297/256.11; 297/256.12

(58) Field of Classification Search
USPC ..... 297/148, 256.11, 256.12, 256.13, 297/256.16, 344.12, 440.14
See application file for complete search history.

(56) References Cited

U.S. PATENT DOCUMENTS

| | | | | |
|---|---|---|---|---|
| 1,739,366 | A | 12/1929 | Lang | |
| 2,521,281 | A | 9/1950 | Brousseau | |
| 3,316,018 | A * | 4/1967 | Stith | 297/440.1 |
| 4,348,048 | A | 9/1982 | Thevenot | |
| 4,383,714 | A | 5/1983 | Ishida | |
| 4,779,922 | A | 10/1988 | Cooper | |
| 4,867,504 | A * | 9/1989 | Johnson, Jr. | 297/3 |
| 4,936,629 | A * | 6/1990 | Young | 297/256.12 |
| 4,957,302 | A | 9/1990 | Maxwell | |
| 4,998,307 | A * | 3/1991 | Cone | 5/94 |
| 5,090,772 | A * | 2/1992 | Ogle et al. | 297/440.14 |
| 5,213,554 | A * | 5/1993 | Goldstein et al. | 482/52 |
| 5,328,246 | A * | 7/1994 | Sereboff | 297/411.36 |
| 5,380,062 | A * | 1/1995 | Nania | 297/256.13 |
| 5,527,090 | A | 6/1996 | Cone, II | |
| 5,732,849 | A * | 3/1998 | Brooks | 220/603 |
| 5,810,432 | A | 9/1998 | Haut et al. | |
| 6,033,019 | A | 3/2000 | Hession-Kunz et al. | |
| 6,056,363 | A | 5/2000 | Maddox | |
| 6,382,725 | B1 | 5/2002 | Carroll | |
| 6,454,350 | B1 | 9/2002 | Celestina-Krevh et al. | |
| 6,554,358 | B2 | 4/2003 | Kain | |
| 6,746,080 | B2 | 6/2004 | Tsugimatsu et al. | |

(Continued)

FOREIGN PATENT DOCUMENTS

GB 2 216 405 A 10/1989

OTHER PUBLICATIONS

Safety 1st "Sit, Snack & Go 5 Mode Booster Seat," available online at http://www.safety1st.com/usa/eng/Products/Child-Care/Booster-Seats/Details/2160-21046-Sit,-Snack-Go-5-Mode-Booster-Seat as early as Jul. 7, 2011 (2 pages).

(Continued)

*Primary Examiner* — Philip Gabler
(74) *Attorney, Agent, or Firm* — Faegre Baker Daniels, LLP

(57) ABSTRACT

The present disclosure relates to a seat configured to swivel, recline, and raise to accommodate a child during feeding.

21 Claims, 22 Drawing Sheets

(56) References Cited

U.S. PATENT DOCUMENTS

| | | | | |
|---|---|---|---|---|
| 6,769,740 | B2 * | 8/2004 | Yamada | 297/366 |
| 6,773,060 | B2 | 8/2004 | Sher et al. | |
| 6,832,813 | B2 | 12/2004 | Tomas et al. | |
| 6,920,830 | B1 | 7/2005 | Asbach et al. | |
| 7,073,859 | B1 | 7/2006 | Wilson | |
| 7,104,603 | B2 | 9/2006 | Keegan et al. | |
| 7,163,265 | B2 * | 1/2007 | Adachi | 297/256.12 |
| 7,328,941 | B2 | 2/2008 | Asbach et al. | |
| 7,387,337 | B2 | 6/2008 | Keegan et al. | |
| 2003/0015903 | A1 * | 1/2003 | Myers | 297/344.21 |
| 2003/0102702 | A1 | 6/2003 | Daley et al. | |
| 2005/0242632 | A1 * | 11/2005 | Asbach et al. | 297/148 |
| 2009/0127893 | A1 * | 5/2009 | Brunick et al. | 297/130 |

OTHER PUBLICATIONS

Images of Safety 1st "Sit, Snack & Go 5 Mode Booster Seat," product marked as Copyright 2008 (4 pages).

Fisher-Price Babygear, "SpaceSaver High Chair" downloaded from Internet at http://www.fisher-price.com/fp.aspx?st=2002&e=product&pid=52492&ncat=thumbnail&pcat=bhg; Jan. 15, 2010.

European Patent Office, International Search Report and Written Opinion for International Application No. PCT/US2010/021382, Jul. 29, 2010, 11 pages.

* cited by examiner

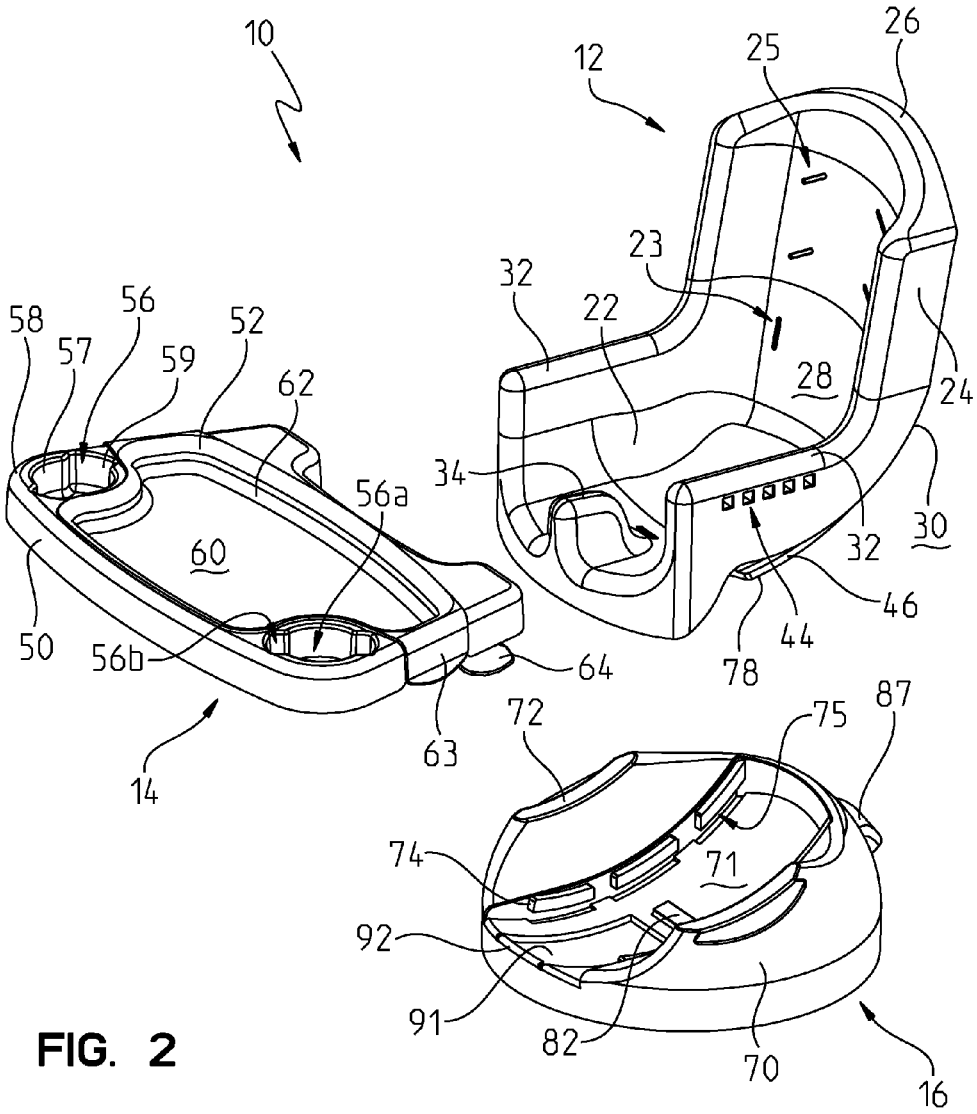
FIG. 2
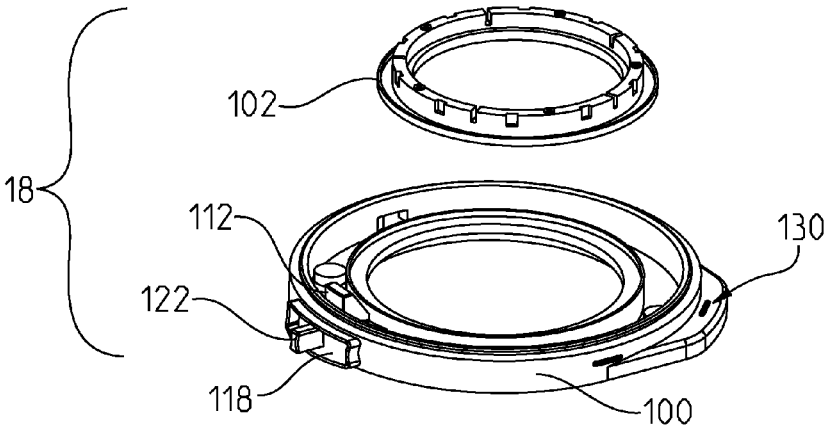

SWIVEL FEEDING SEAT

CROSS-REFERENCE TO RELATED APPLICATION

This application claims priority from U.S. Provisional Patent Application No. 61/145,676, entitled "Swivel Feeding Seat," filed on Jan. 19, 2009, by the same inventors hereof, the disclosure of which is expressly incorporated herein by reference.

FIELD OF THE INVENTION

The present invention relates to a seat for use when feeding a child. More particularly, the present invention relates to a seat configured to swivel, recline, and raise to accommodate a child during feeding.

BACKGROUND AND SUMMARY

As children grow and develop, their needs and capabilities change. For example, infants are not able to sit upright in a chair, but toddlers with developed stomach, back, and neck muscles are able to sit upright in a chair. Thus, an infant may be fed in a reclined position, while a toddler may be fed in a seated, upright position. As another example, infants generally cannot feed themselves, but toddlers are able to feed themselves. Thus, an infant may be fed facing a caregiver seated next to the infant, while a toddler may sit facing a standard dining table.

The present disclosure provides a seat configured to swivel, recline, and raise to accommodate a child during feeding.

In one form thereof, the present disclosure provides a child's seat assembly including a seat having a top surface that is contoured to support a child in a seated position and a bottom surface, a tray coupled to the seat, and a swivel base that supports the seat, the seat being rotatable relative to the swivel base about a vertical axis.

In another form thereof, the present disclosure provides a child's seat assembly including a seat having a top surface that is contoured to support a child in a seated position and an arcuate bottom surface, a tray coupled to the seat, and a base that defines an arcuate platform for supporting the arcuate bottom surface of the seat as the seat reclines and inclines relative to the base, the seat including a first coupling member and the base including a second coupling member, the first and second coupling members engaging to couple the seat onto the base, the seat being removable from the base by reclining or inclining the seat relative to the base until the first and second coupling members are disengaged.

In yet another form thereof, the present disclosure provides a child's seat assembly including a base and a seat coupled to the base, the seat having a top surface that is contoured to support a child in a seated position and a bottom surface, the seat including a bench portion, an intermediate portion removably coupled to the bench portion, and a head portion removably and interchangeably coupled to the bench portion and the intermediate portion. The seat is adjustable between a first configuration in which the head portion is coupled to the intermediate portion and the intermediate portion is coupled to the bench portion and a second configuration in which the intermediate portion is removed and the head portion is coupled to the bench portion.

In still yet another form thereof, the present disclosure provides a child's seat assembly including a base, a seat coupled to the base, the seat having a top surface that is contoured to support a child in a seated position and a bottom surface, a primary tray coupled to the seat, and a secondary tray removably coupled atop the primary tray, the secondary tray having at least one resilient arm that snaps beneath the primary tray to secure the secondary tray onto the primary tray.

BRIEF DESCRIPTION OF THE DRAWINGS

The above-mentioned and other features of the disclosure, and the manner of attaining them, will become more apparent and will be better understood by reference to the following description of embodiments of the disclosure taken in conjunction with the accompanying drawings, wherein:

FIG. 2 is a top, front exploded perspective view of the feeding seat of FIG. 1;

Figure 1:
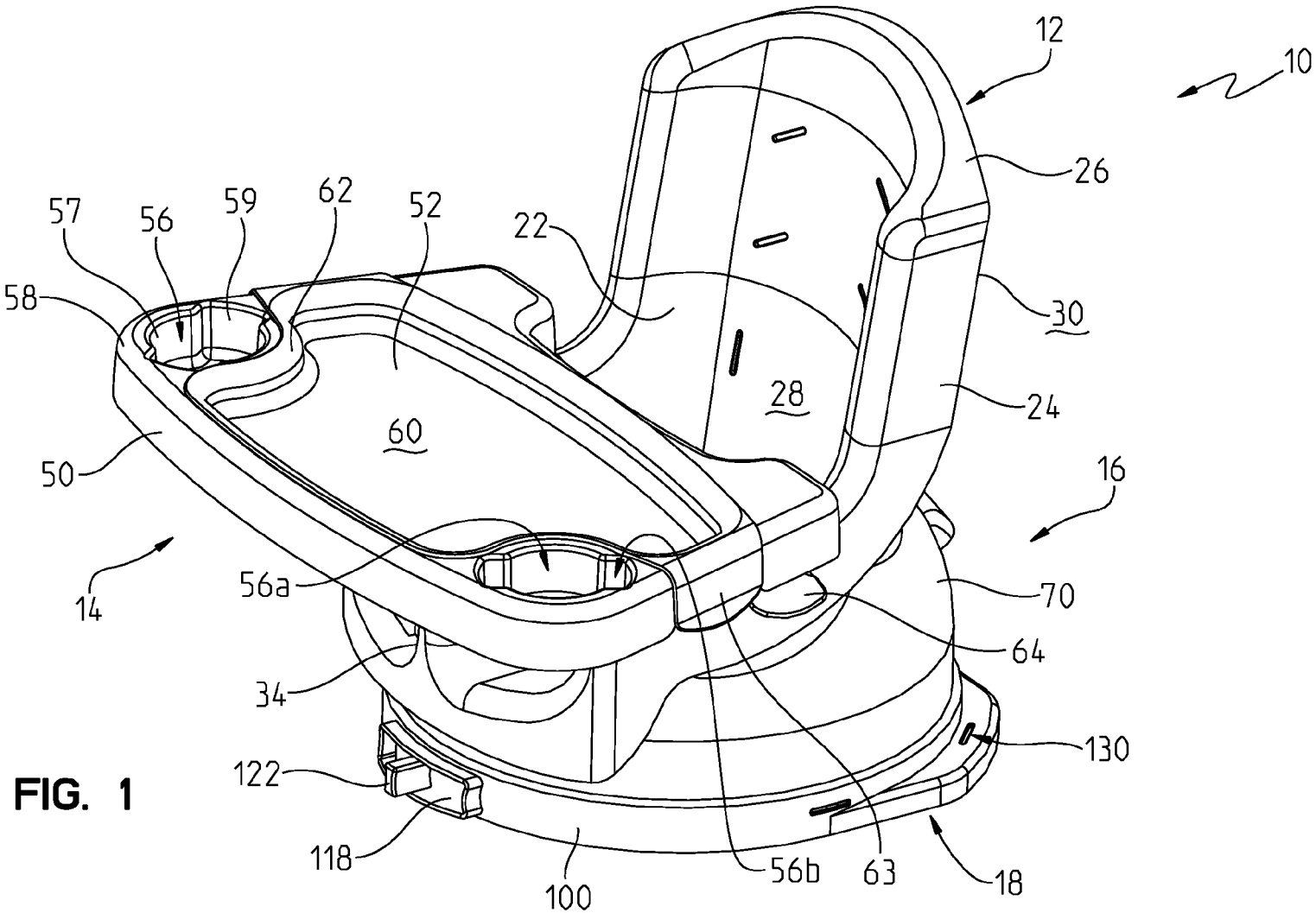
FIG. 1 is a perspective view of a feeding seat in accordance with an illustrative embodiment of the present disclosure.

Corresponding reference characters indicate corresponding parts throughout the several views. Although the drawings represent embodiments of the present disclosure, the drawings are not necessarily to scale and certain features may be exaggerated in order to better illustrate and explain the present invention.

DETAILED DESCRIPTION OF THE DRAWINGS

The embodiments disclosed below are not intended to be exhaustive or to limit the invention to the precise forms disclosed in the following detailed description. Rather, the embodiments are chosen and described so that others skilled in the art may utilize their teachings.

Figure 18:
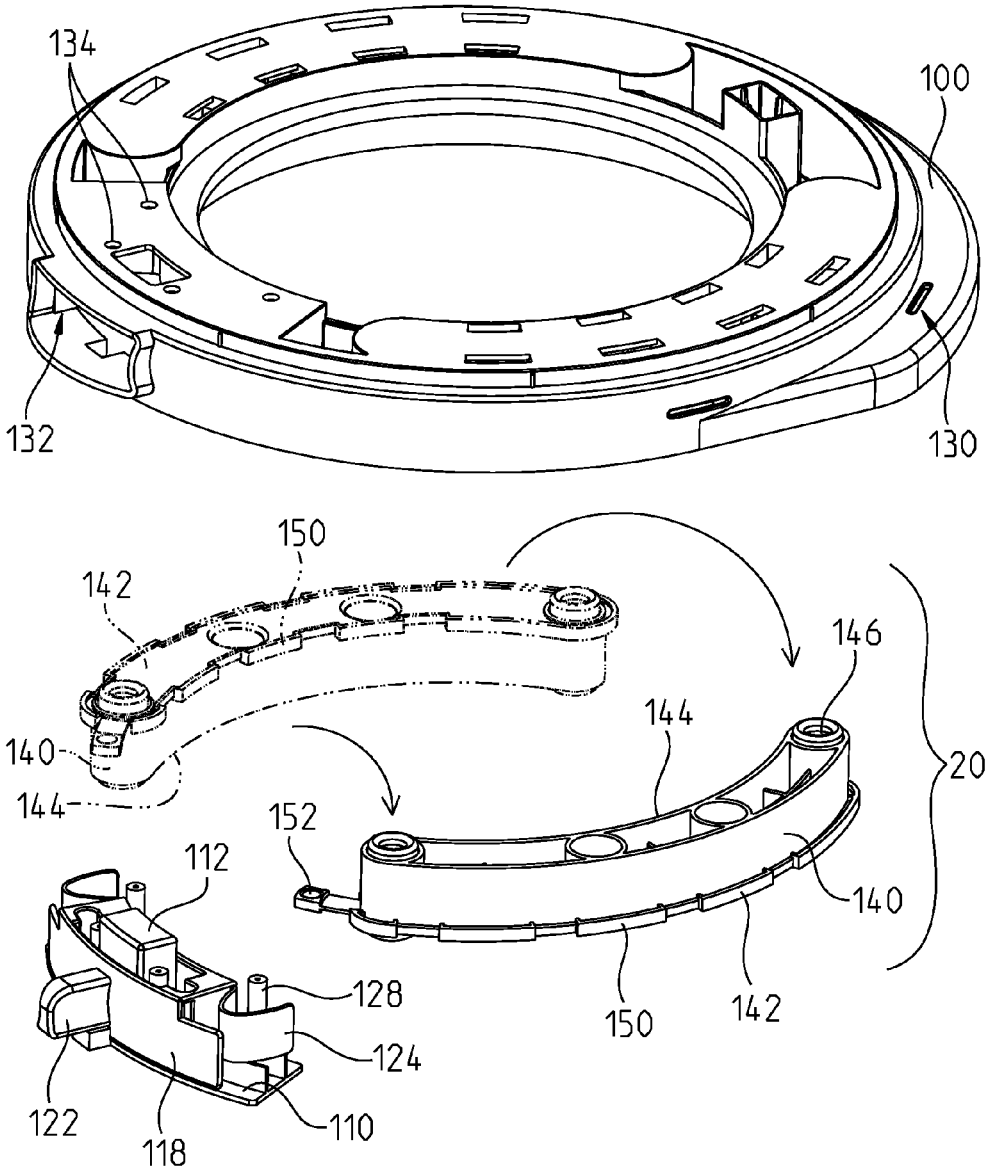
FIG. 18 is a top, front exploded perspective view of a lift assembly in accordance with an illustrative embodiment of the present disclosure, showing a riser in a raised position and the same riser flipped over in a lowered position.

Referring to FIGS. 1-4, an exemplary feeding seat 10 is illustrated having seat assembly 12, removable tray assembly 14, recline assembly 16, swivel assembly 18, and lift assembly 20 (FIG. 18). Each component of feeding seat 10 may be injection molded from plastic, such as polypropylene, or another suitable material.

Figure 3:
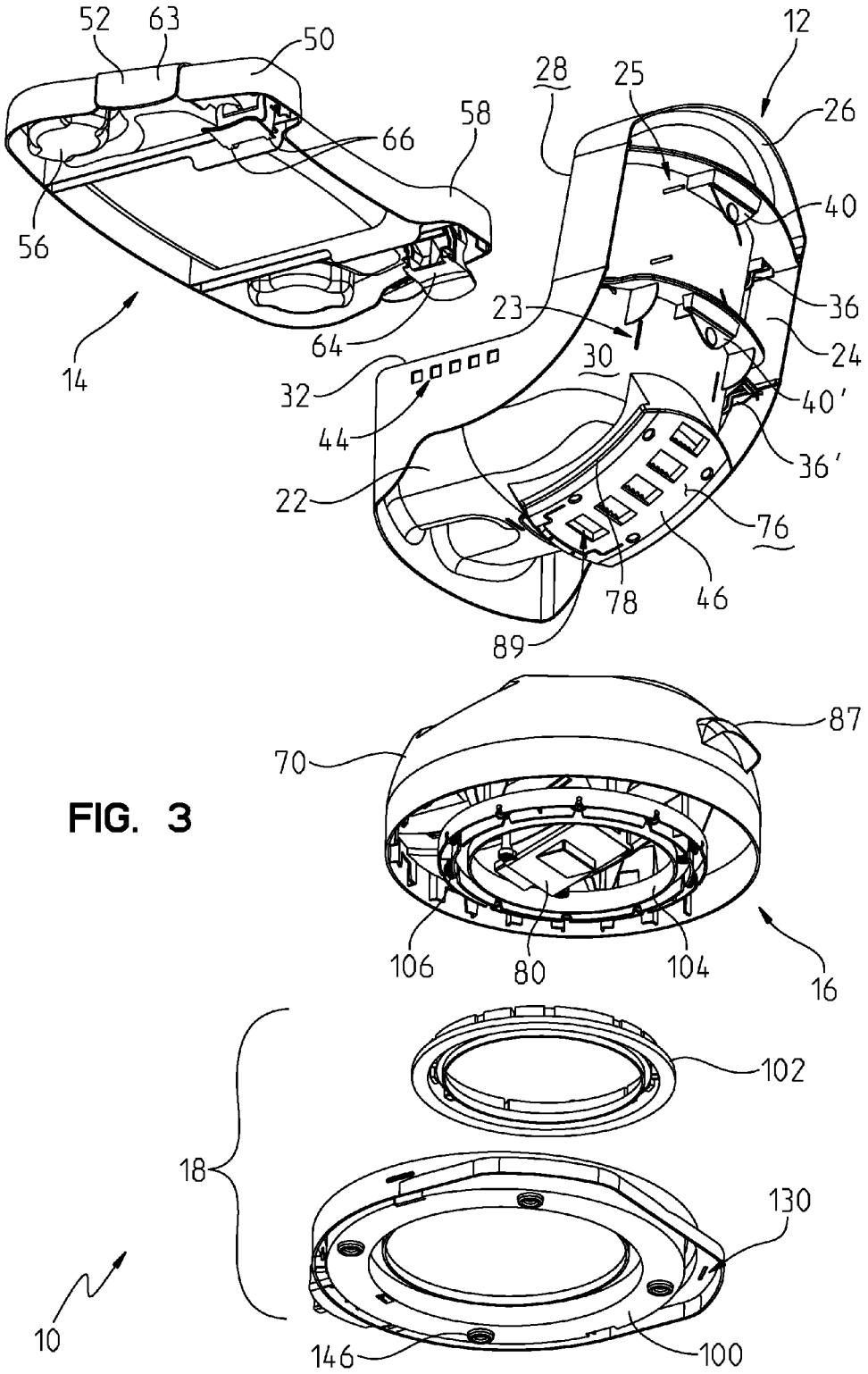
FIG. 3 is a bottom, rear exploded perspective view of the feeding seat of FIG. 1.
Figure 5:
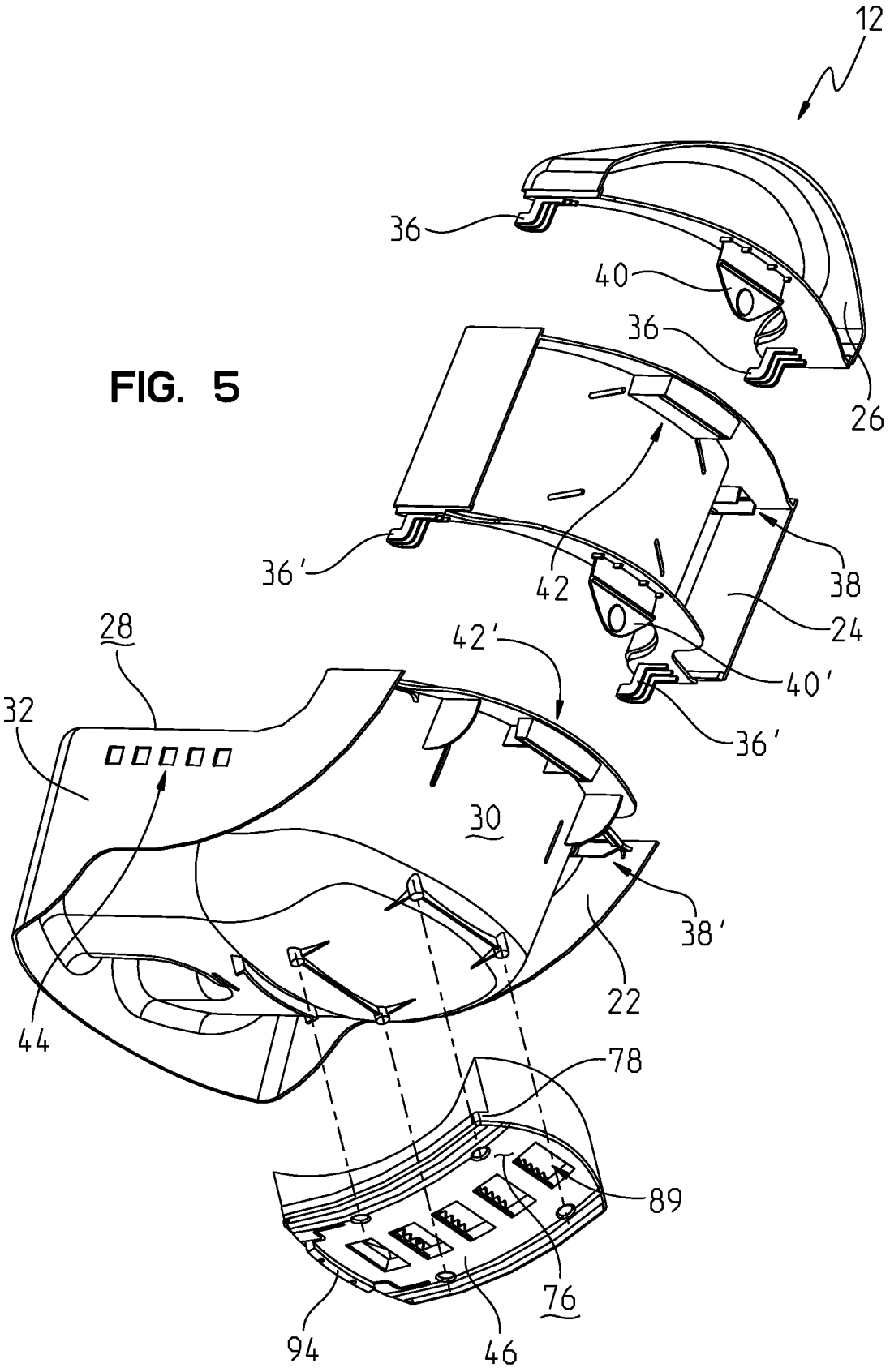
FIG. 5 is a bottom, rear exploded perspective view of a seat assembly in accordance with an illustrative embodiment of the present disclosure.

Referring next to FIGS. 2 and 5, seat assembly 12 includes bench portion 22, intermediate portion 24, and head portion 26. Bench portion 22, intermediate portion 24, and head portion 26 of seat assembly 12 cooperate to define top surface 28 and bottom surface 30 of seat assembly 12. Top surface 28 of seat assembly 12 is contoured to fit the buttocks, back, and possibly the head and neck, of a seated child, depending on the child's height. Two arms 32 and crotch restraint 34 extend upwardly from top surface 28 of seat assembly 12. When a child is seated on top surface 28 of seat assembly 12 between arms 32, crotch restraint 34 extends between the child's legs to prevent the seated child from slipping out of seat assembly 12. As shown in FIGS. 2 or 3, seat assembly 12 defines a plurality of openings 23, 25 for receiving restraint straps (not shown) through seat assembly 12. More specifically, bench portion 22 of seat assembly 12 defines lower openings 23 that are positioned to receive a lower restraint strap (e.g., a waist-level restraint strap) (not shown), and intermediate portion 24 of seat assembly 12 defines upper openings 25 that are positioned to receive an upper restraint strap (e.g., a shoulder-level restraint strap) (not shown).

Bench portion 22, intermediate portion 24, and head portion 26 of seat assembly 12 may be detachably secured to one another using suitable interconnecting features. For example, in the illustrated embodiment of FIG. 5, head portion 26 includes multiple hooks 36 that snap into corresponding grooves 38 of intermediate portion 24. Head portion 26 also includes extension 40 that extends into slot 42 of intermediate portion 24 to support and stabilize the connection between head portion 26 and intermediate portion 24. Intermediate portion 24 may be provided with similar or different interconnecting features compared to head portion 26 to detachably secure intermediate portion 24 to bench portion 22. For example, in the illustrated embodiment of FIG. 5, intermediate portion 24 includes multiple hooks 36' that snap into corresponding grooves 38' of bench portion 22. Head portion 26 also includes extension 40' that extends into slot 42' of bench portion 22 to support and stabilize the connection between intermediate portion 24 and bench portion 22. Because bench portion 22, intermediate portion 24, and head portion 26 are detachably secured to one another, seat assembly 12 may be disassembled for storage, cleaning, or transportation.

To adjust the height of seat assembly 12, intermediate portion 24 may be removed, and head portion 26 may be secured directly to bench portion 22. According to an exemplary embodiment of the present disclosure, head portion 26 and intermediate portion 24 share the same interconnecting features as intermediate portion 24 and bench portion 22. For example, as shown in FIG. 5, hooks 36 extending from head portion 26 are the same as hooks 36' extending from intermediate portion 24, and extension 40 extending from head portion 26 is the same as extension 40' extending from intermediate portion 24. Also, grooves 38 in intermediate portion 24 are the same as grooves 38' in bench portion 22, and slot 42 in intermediate portion 24 is the same as slot 42' in bench portion 22. Therefore, hooks 36 and extension 40 of head portion 26 may be received within either corresponding grooves 38 and slot 42 of intermediate portion 24 or corresponding grooves 38' and slot 42' of bench portion 22. With intermediate portion 24 in place between bench portion 22 and head portion 26, seat assembly 12 may be tall enough to support the buttocks, back, neck, and head, of an infant, similar to a car seat. Without intermediate portion 24 in place between bench portion 22 and head portion 26, seat assembly 12 may function as a toddler's booster seat, supporting the buttocks and the back of the seated toddler.

As shown in FIG. 5, seat assembly 12 also includes multiple tray recesses 44. Specifically, each arm 32 of seat assembly 12 includes multiple tray recesses 44. Tray recesses 44 are provided to adjust the position of tray assembly 14 relative to seat assembly 12, as described in more detail below.

Figure 6:
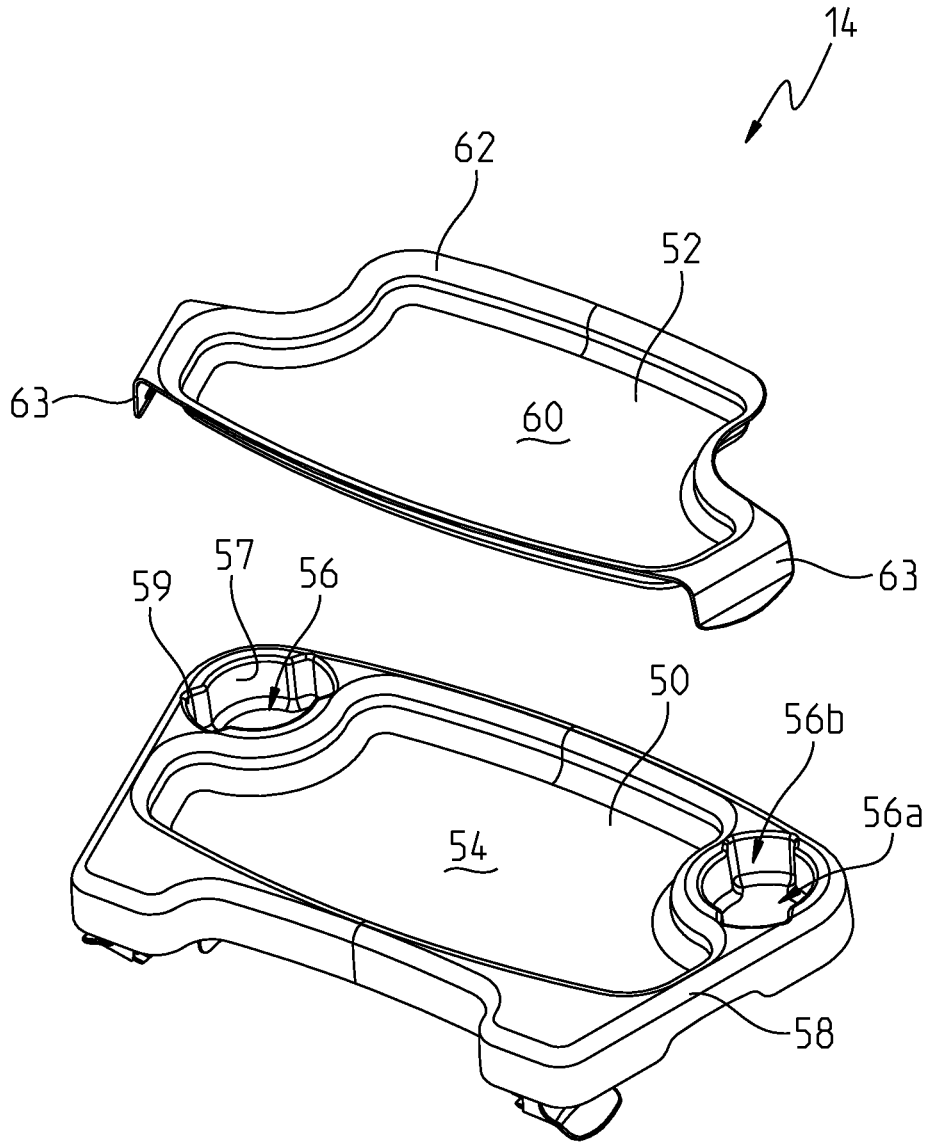
FIG. 6 is a top, front exploded perspective view of a tray assembly in accordance with an illustrative embodiment of the present disclosure.

Referring next to FIG. 6, tray assembly 14 includes primary tray 50 and secondary tray 52. Primary tray 50 includes table surface 54. Primary tray 50 also includes one or more cup holders 56 and raised lip 58 surrounding the outer periphery of primary tray 50, both designed to prevent food and drinks from falling off of table surface 54. According to an exemplary embodiment of the present invention, cup holder 56 is defined by at least one circular portion 57 of primary tray 50 and at least one extension portion 59 of primary tray 50 that extends outwardly from circular portion 57. In the illustrated embodiment of FIG. 6, opposing circular portions 57 and opposing extension portions 59 cooperate to define cup holder 56 having a central circular opening **56*a* and two expanded openings 56*b* spaced radially opposite from one other outside of the central circular opening 56*a*. In use, cup holder 56 may be configured to receive and retain drinking cups of various shapes. For example, a circular-shaped cup may be positioned and retained within the central circular opening 56*a* of cup holder 56. If the drinking cup includes a handle, the handle may extend into one or both expanded openings 56*b* of cup holder 56. As another example, a rectangular-shaped cup, such as a juice box, may extend through central circular opening 56*a* of cup holder 56 and into one or both expanded openings 56*b* of cup holder 56**.

Secondary tray 52 is sized and shaped to rest atop primary tray 50. Like primary tray 50, secondary tray 52 includes table surface 60 and raised lip 62 that surrounds table surface 60 to prevent food and drinks from falling off of table surface 60. When assembled, raised lip 62 of secondary tray 52 rests against raised lip 58 of primary tray 50. As shown in FIG. 1, secondary tray 52 may be shaped to avoid interfering with cup holder 56 of primary tray 50. In this embodiment, secondary tray 52 may be attached to primary tray 50 and removed from primary tray 50 without having to remove the child's drink from cup holder 56. Also, raised lip 62 of secondary tray 52 may span raised lip 58 of primary tray 50 to cover the entire table surface 54 of primary tray 50. In this embodiment, gaps may be avoided between primary tray 50 and secondary tray 52 that might catch food and make cleaning difficult.

Secondary tray 52 may be detachably secured to primary tray 50 using suitable interconnecting features. For example, as shown in FIG. 6, secondary tray 52 includes multiple resilient arms 63 that are configured to snap onto primary tray 50. More specifically, resilient arms 63 are configured to wrap around raised lip 58 of primary tray 50 and snap beneath primary tray 50. In use, food may be served upon secondary tray 52, and then secondary tray 52 may be detached from primary tray 50 and cleaned without having to also remove and clean primary tray 50.

Referring back to FIGS. 1-4, tray assembly 14 rests atop seat assembly 12. Specifically, tray assembly 14 rests atop arms 32 of seat assembly 12. Tray assembly 14 is configured to slide forward and backward across arms 32 of seat assembly 12. To secure tray assembly 14 in place relative to seat assembly 12, tray assembly 14 includes two hinged lock mechanisms 64 positioned on opposite sides of tray assembly 14. In the illustrated embodiment, each lock mechanism 64 includes two fingers 66 that are biased toward seat assembly 12 to engage corresponding tray recesses 44 in seat assembly 12. To adjust the position of tray assembly 14, both lock mechanisms 64 may be pressed to separate fingers 66 from tray recesses 44 in seat assembly 12. Tray assembly 14 may then be moved forward and backward relative to seat assembly 12. When the desired position of tray assembly 14 is reached, lock mechanisms 64 may be released until fingers 66 spring back into engagement with the adjacent tray recesses 44. The attachment of tray assembly 14 to seat assembly 12 may be performed according to the teachings of U.S. Pat. No. 6,033,019, the disclosure of which is expressly incorporated by reference herein.

Optionally, tray assembly 14 may be separated from feeding seat 10 during feeding. For example, when feeding an older child, feeding seat 10 may be secured to a standard dining chair and positioned adjacent to a standard dining table to function as a booster seat. Tray assembly 14 may also be separated from feeding seat 10 when the child participates in activities other than eating, such as coloring, drawing, game playing, or other similar activities.

Figure 4:
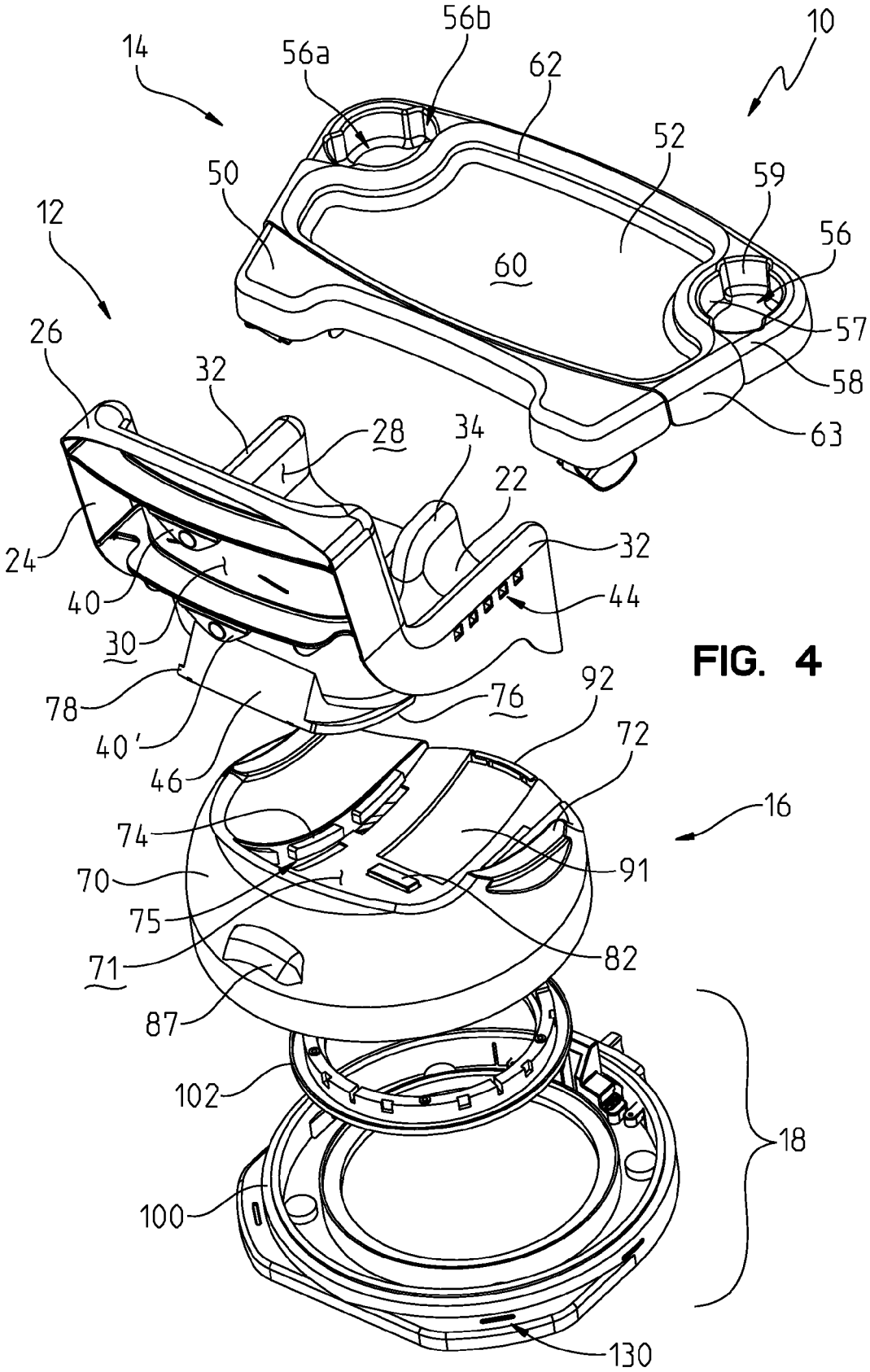
FIG. 4 is a top, rear exploded perspective view of the feeding seat of FIG. 1.

As shown in FIGS. 2 and 4, recline assembly 16 is provided to adjust the tilt or angle of seat assembly 12 of feeding seat 10. Recline assembly 16 includes recline base 70 having arcuate platform 71 and arm supports 72 that extend upwardly from platform 71 and into arms 32 of seat assembly 12. Also, recline base 70 includes at least one guide rail 74 that projects inwardly from a corresponding arm support 72 at a location above arcuate platform 71 to define groove 75 located below guide rail 74 and above arcuate platform 71. Guide rails 74 may be attached to arm supports 72 or integrally formed with arm supports 72. In the illustrated embodiment, each arm support 72 includes three spaced apart guide rails 74, but it is within the scope of the present disclosure that each arm support 72 may include one continuous guide rail 74 or any other suitable number of spaced apart guide rails 74. According to an exemplary embodiment of the present disclosure, guide rails 74 may have a radius of curvature that matches the curvature of arcuate platform 71.

As shown in FIG. 5, recline assembly 16 further includes rack 46. Rack 46 may be bolted, screwed, or otherwise coupled to seat assembly 12, and specifically bottom surface 30 of seat assembly 12. Rack 46 and seat assembly 12 coupled thereto are configured to recline and incline against recline base 70. In the illustrated embodiment, rack 46 includes arcuate surface 76 that is shaped to articulate with arcuate platform 71 of recline base 70 (FIG. 2). According to an exemplary embodiment of the present disclosure, rack 46 and arcuate platform 71 may have the same radius of curvature.

As shown in FIG. 4, rack 46 of recline assembly 16 also includes tongues 78 that are configured to interact with guide rails 74 of recline base 70. Specifically, each tongue 78 is configured to slide within a corresponding groove 75. As mentioned above, grooves 75 may be defined above by guide rails 74 and below by arcuate platform 71. According to an exemplary embodiment of the present disclosure, tongues 78 may have a radius of curvature that matches the curvature of arcuate platform 71 and/or guide rails 74. In use, as arcuate surface 76 of rack 46 slides across arcuate platform 71 of recline assembly 16, tongues 78 of rack 46 slide within grooves 75 in a tongue-and-groove arrangement.

Figure 10:
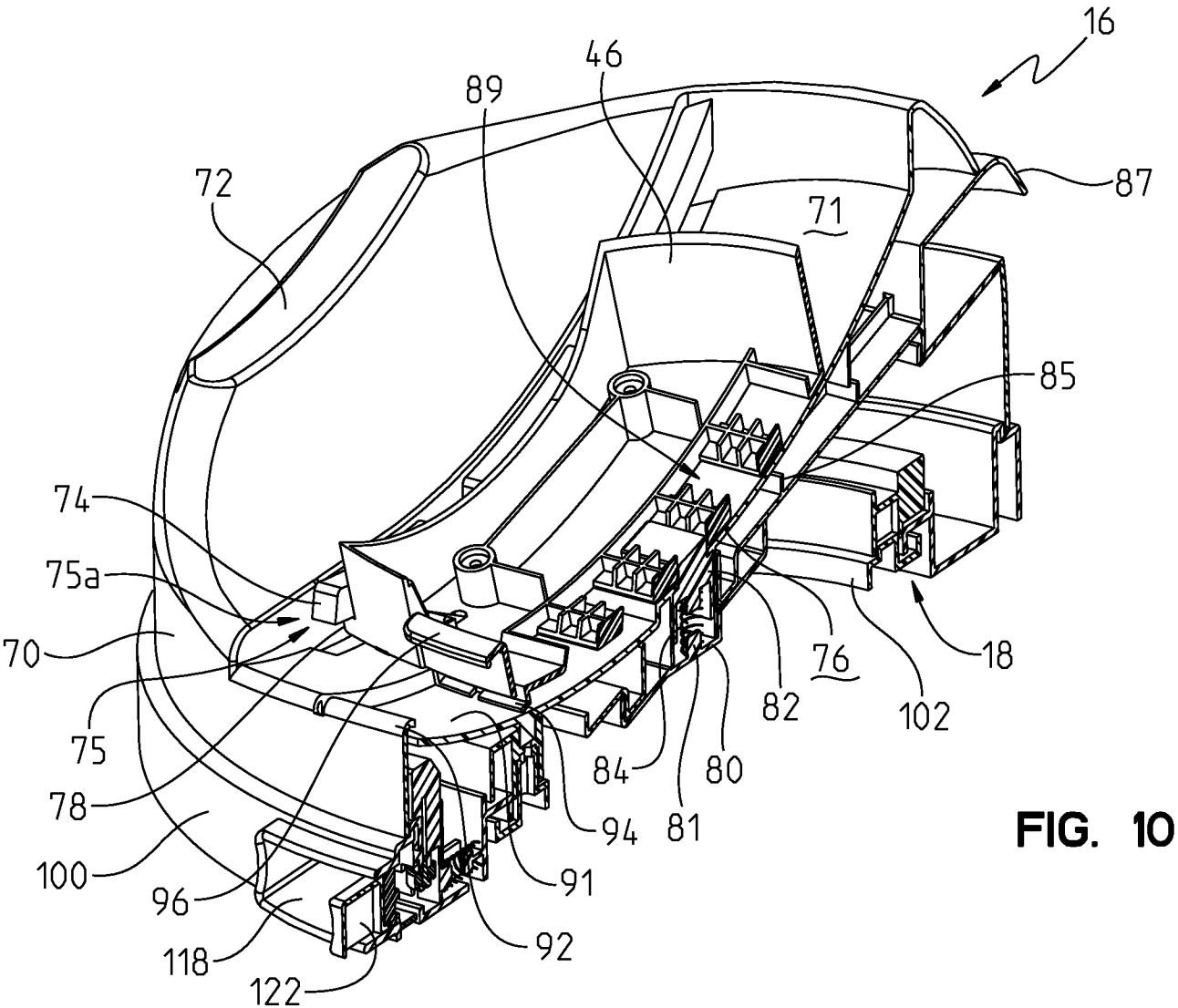
FIG. 10 is a cross-sectional perspective view of the recline assembly of FIG. 7, showing the recline assembly in an intermediate reclined position.
Figure 11:
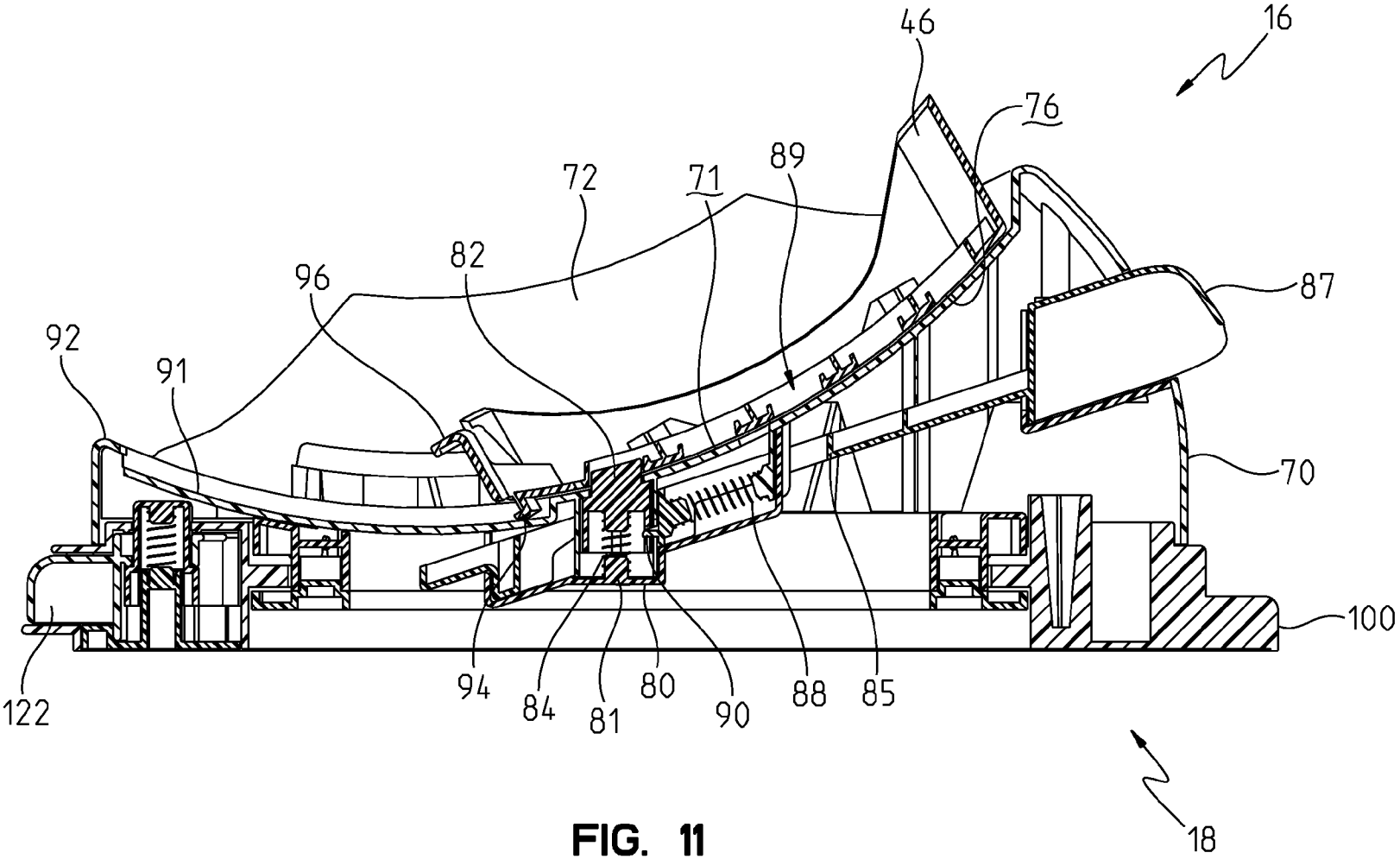
FIG. 11 is a cross-sectional view of a recline assembly in accordance with another illustrative embodiment of the present disclosure, showing the recline assembly in an upright or fully inclined position.
Figure 12:
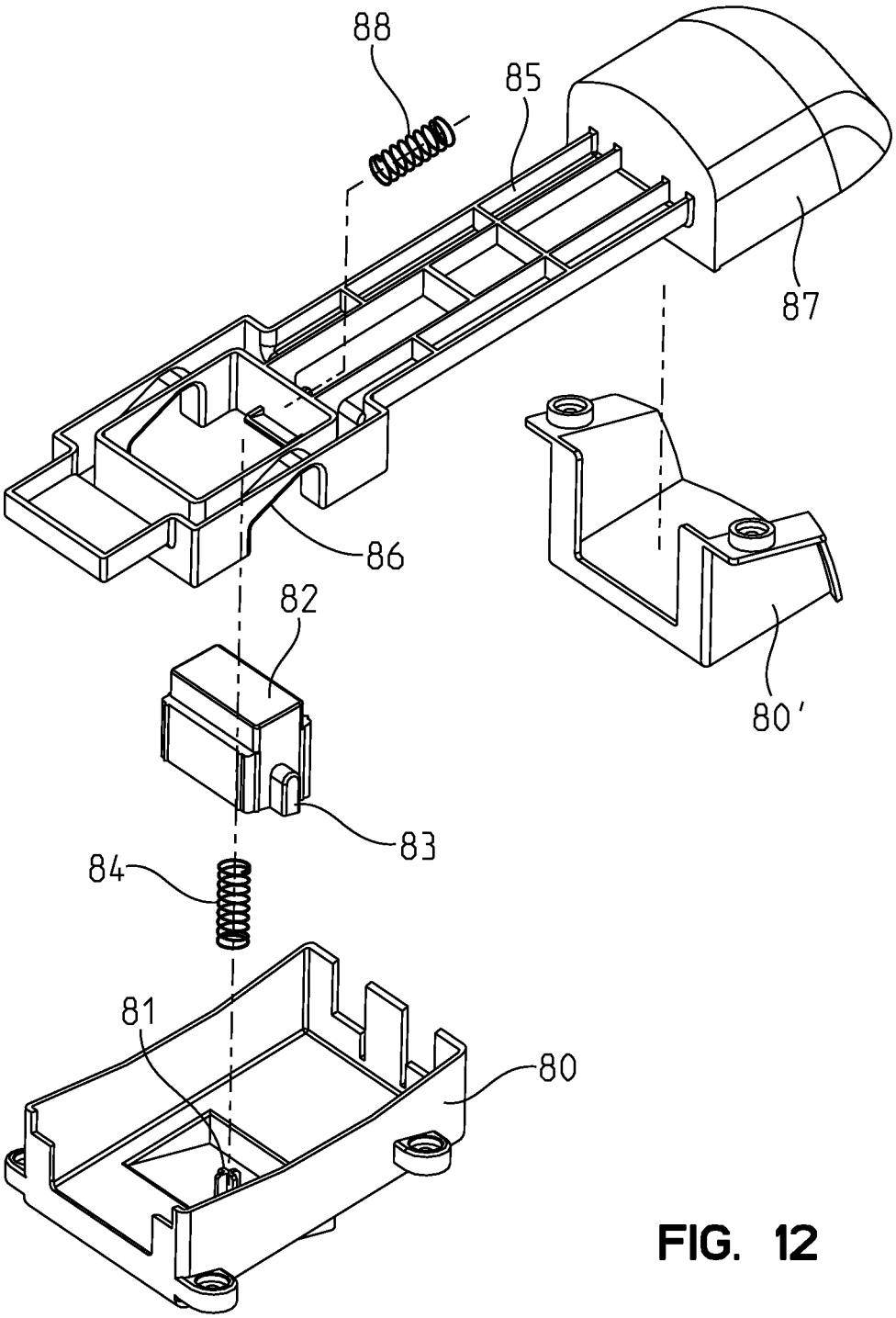
FIG. 12 is an exploded perspective view of a recline latch mechanism in accordance with an illustrative embodiment of the present disclosure.

Referring next to FIGS. 7-12, recline assembly 16 is provided with a recline latch mechanism to adjust and control the angle or tilt of seat assembly 12. An exemplary recline latch mechanism is normally biased in a locked position to prevent movement of seat assembly 12, but may be unlocked when a user desires to adjust the angle of seat assembly 12. For example, as best shown in FIG. 12, an exemplary recline latch mechanism of recline assembly 16 may include frame 80 having guide post 81, stopper 82 having protrusion 83, spring 84, latch 85 having ramped engagement surface 86, handle 87, and return spring 88. Frame 80 may be bolted or otherwise secured to recline base 60 to support stopper 82 and latch 85. In the illustrated embodiment of FIG. 12, the recline latch mechanism further includes a secondary frame 80' to further support latch 85. As best shown in FIG. 5, rack 46 of seat assembly 12 may include multiple notches 89 that are sized to receive stopper 82.

In use, spring 84 normally biases stopper 82 upward to project beyond arcuate platform 71 of recline base 70 and into a corresponding notch 89 in rack 46. In this locked position, rack 46 and seat assembly 12 coupled thereto are prevented from reclining relative to recline base 70. To adjust the angle of seat assembly 12, a user pulls handle 87 of latch 85, causing the downward-sloping, ramped engagement surface 86 of latch 85 to travel across protrusion 83 of stopper 82 and, as a result, forcing stopper 82 downward over guide post 81 and out of engagement with rack 46. When the user releases handle 87 of latch 85, return spring 88 or a similar biasing structure contacts a stationary structure, such as recline base 70 or frame 80, to return latch 85 to the locked position. As the now upward-sloping, ramped engagement surface 86 of latch 85 travels across protrusion 83 of stopper 82, spring 84 forces stopper 82 upward over guide post 81 and back into locked engagement with rack 46.

Referring next to FIG. 11, latch 85 may include barrier 90. In the locked position, barrier 90 extends beneath stopper 82 and, along with spring 84, prevents stopper 82 from moving downward and disengaging rack 46. Even if spring 84 were to fail, barrier 90 would prevent stopper 82 from moving downward and disengaging rack 46. When the user pulls handle 87 of latch 85 into the unlocked position, barrier 90 moves out of position to permit stopper 82 to move downward and out of engagement with rack 46.

Figure 7:
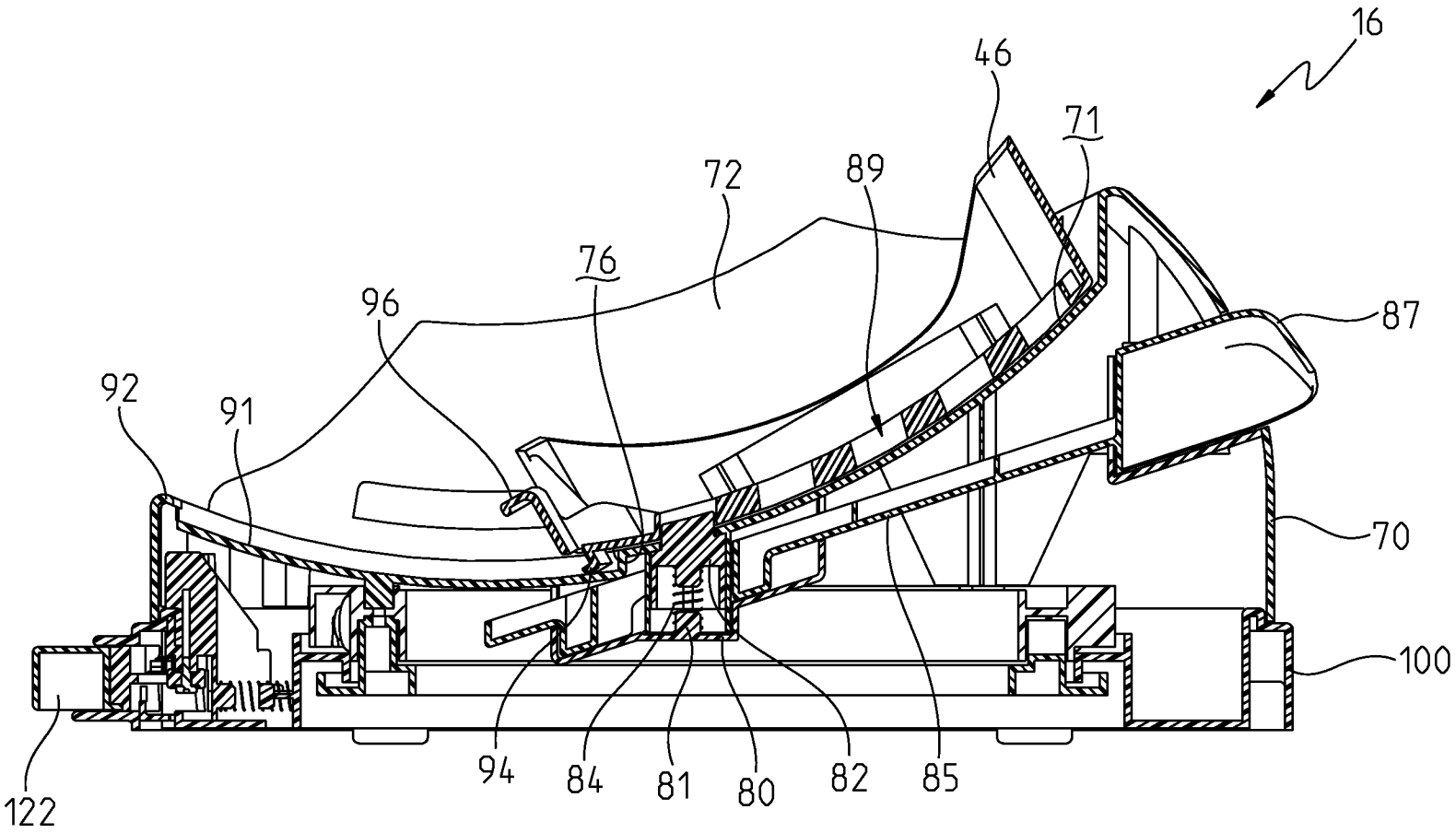
FIG. 7 is a cross-sectional view of a recline assembly in accordance with an illustrative embodiment of the present disclosure, showing the recline assembly in an upright or fully inclined position.
Figure 8:
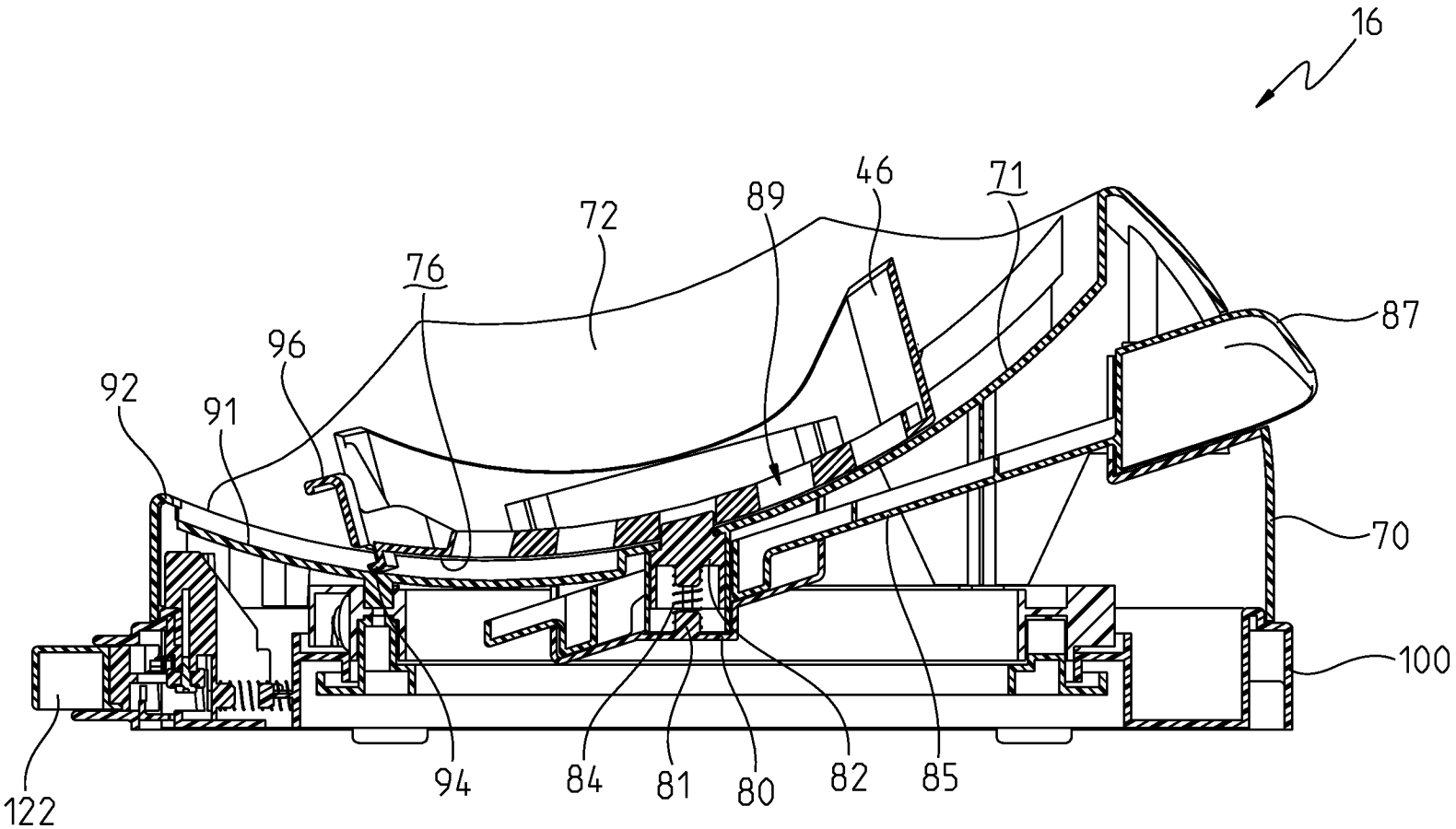
FIG. 8 is a cross-sectional view similar to FIG. 7, showing the recline assembly in an intermediate reclined position.
Figure 9:
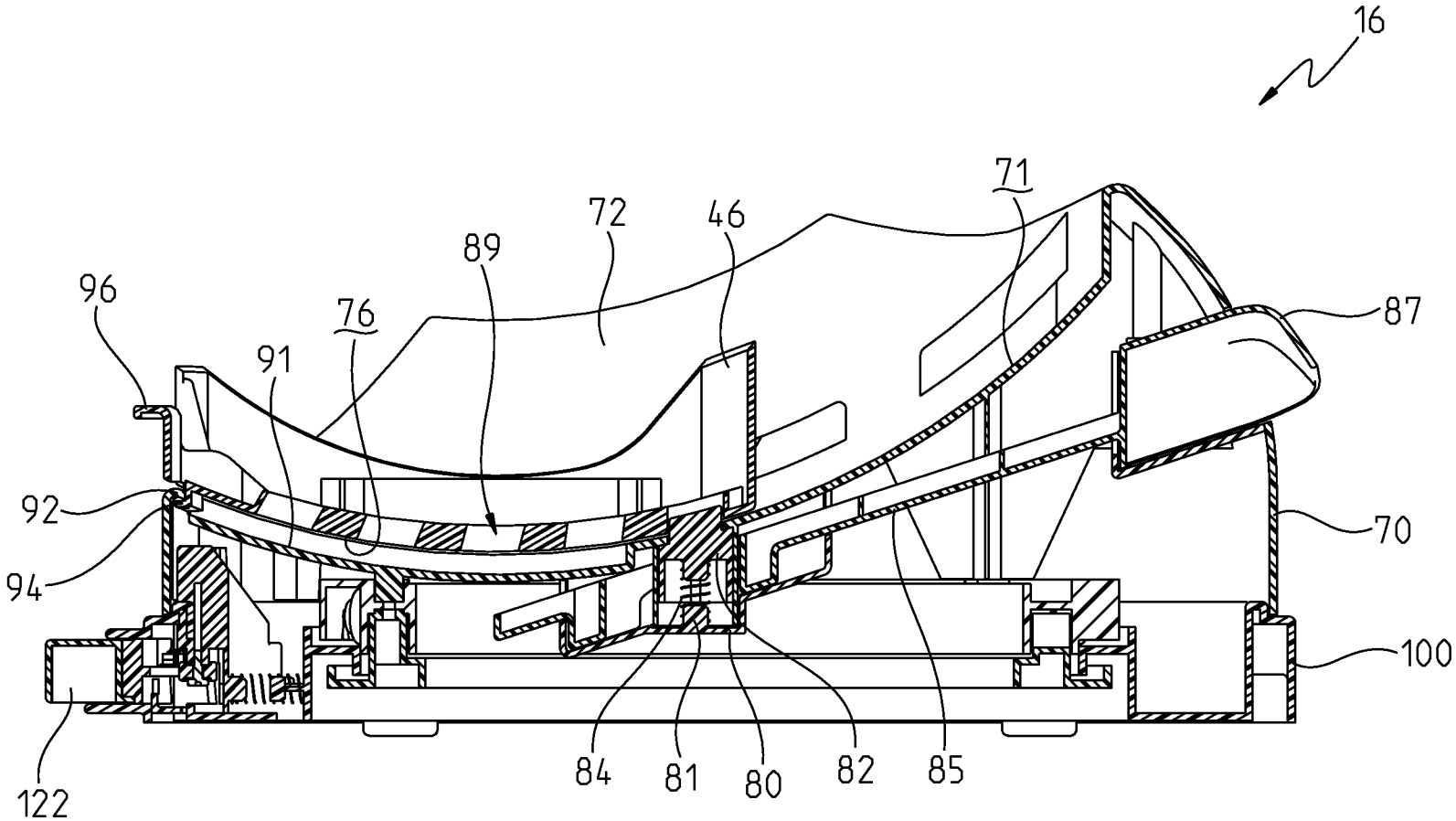
FIG. 9 is a cross-sectional view similar to FIG. 7, showing the recline assembly in a fully reclined position.

As shown in FIGS. 7-9, the number of notches 89 in rack 46 determines the number of possible recline positions of seat assembly 12. In the illustrated embodiment, rack 46 includes five notches 89, so seat assembly 12 (FIG. 1) may be positioned at five different angles relative to recline base 70.

Several of these recline positions are illustrated in FIGS. 7-9. For example, rack 46 is illustrated in an upright or fully inclined position in FIG. 7, an intermediate position in FIG. 8, and a fully reclined position in FIG. 9. Also, the arrangement of notches 89 in rack 46 determines the various angles of seat assembly 12. Even in the upright position of FIG. 7, seat assembly 12, and in particular head portion 26 of seat assembly 12 (FIG. 1), may be slightly reclined from vertical to prevent a child from sliding out of seat assembly 12. For example, in the upright position, seat assembly 12 may be reclined from vertical by approximately 2 degrees, 4 degrees, 6 degrees, 8 degrees, 10 degrees, or more. In the fully reclined position of FIG. 9, seat assembly 12 may be reclined from vertical by approximately 5 degrees, 10 degrees, 15 degrees, 20 degrees, 25 degrees, 30 degrees, or more.

In addition to the recline latch mechanism described above with reference to FIG. 12, recline assembly 16 may also include a recline stop mechanism to prevent seat assembly 12 from sliding out of recline assembly 16. As shown in FIGS. 7-10, recline base 70 includes track 91 set into arcuate platform 71 and a stop or catch 92 located at a forward-most end of track 91, and rack 46 includes a corresponding latch 94. As rack 46 reclines from the upright position of FIG. 7 to the intermediate position of FIG. 8, latch 94 travels freely in track 91 without interfering with the movement of seat assembly 12. However, when rack 46 reaches the fully reclined position of FIG. 9, latch 94 engages catch 92. Even if handle 87 is pulled to unlock stopper 82 from rack 46, the engagement between latch 94 and catch 92 prevents seat assembly 12 from sliding out of recline assembly 16. Therefore, the recline stop mechanism serves as a back-up lock should the recline latch mechanism become unlocked.

As shown in FIG. 10, the recline stop mechanism may be provided with a release mechanism, such as release tab 96. When pressed, release tab 96 forces latch 94 backwards and out of engagement with catch 92. Rack 46 and seat assembly 12 coupled thereto may then be separated from recline base 70 for storage, cleaning, or transportation, for example, by tilting seat assembly 12 until tongues 78 of seat assembly 12 are freed from the open end of grooves 75 beneath guide rails 74. The fact that grooves 75 have at least one open end enables seat assembly 12 to be quickly and easily disassembled from recline base 70 when necessary.

Figure 13:
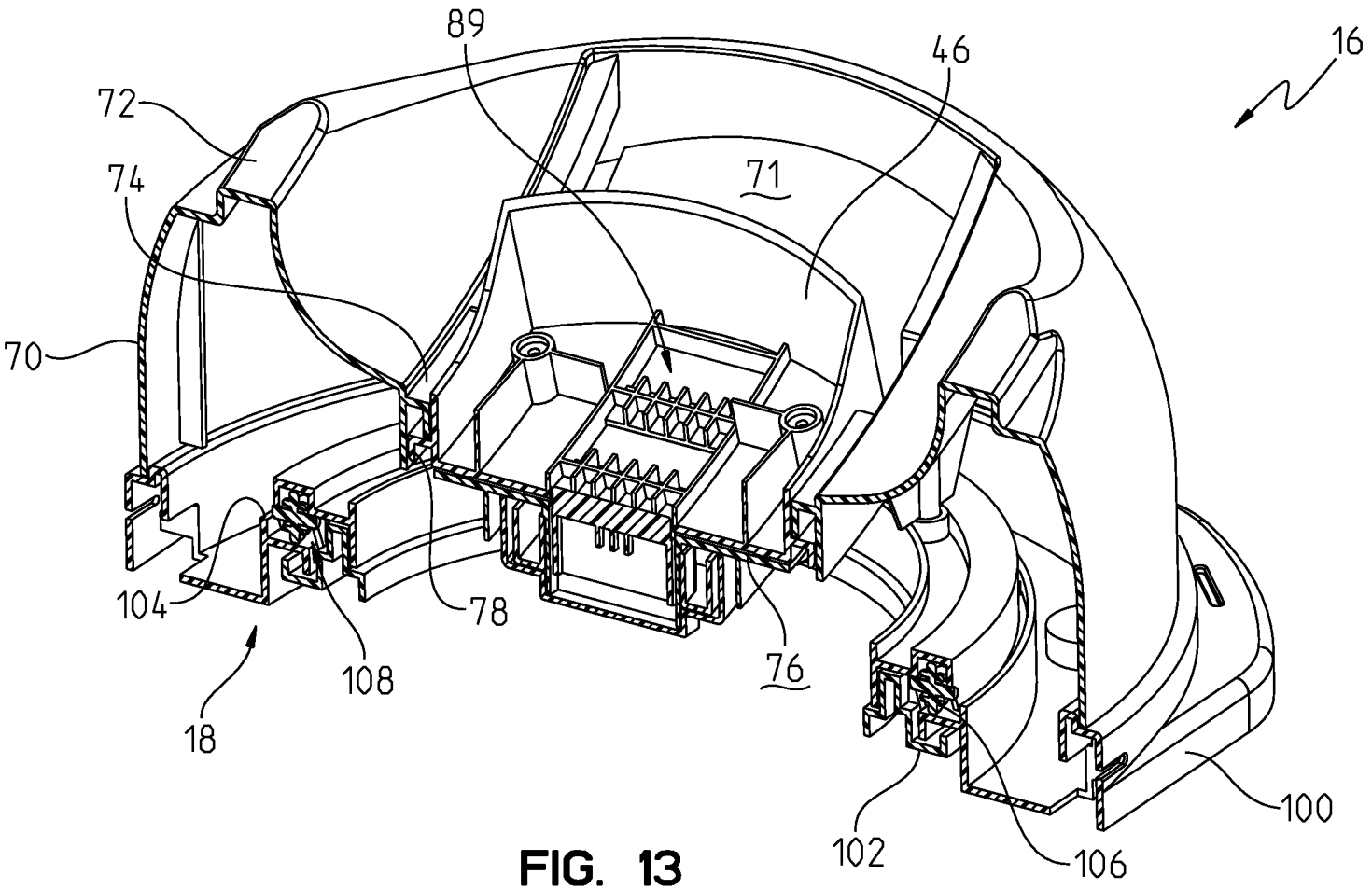
FIG. 13 is another cross-sectional perspective view of the recline assembly of FIG. 7.

Referring next to FIGS. 3 and 13, swivel assembly 18 is provided to rotate seat assembly 12 of feeding seat 10 about a vertical axis. In the illustrated embodiment, swivel assembly 18 includes swivel base 100, insert 102, and roller 104 having a plurality of wheels 106. Swivel base 100 and insert 102 of swivel assembly 18 may be snapped or otherwise coupled together. As shown in FIG. 13, swivel base 100, alone or in combination with insert 102, defines annular track 108.

Figure 14:
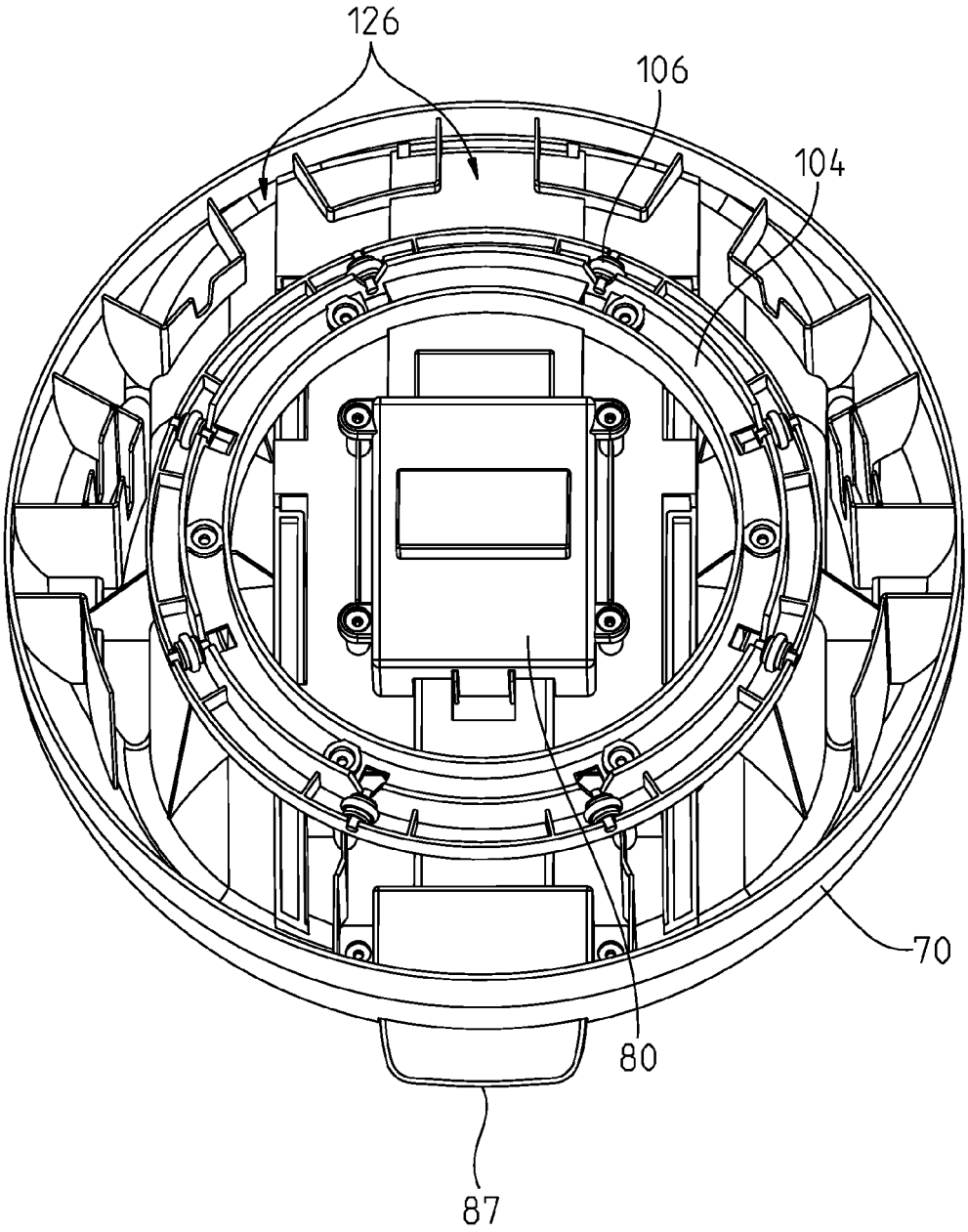
FIG. 14 is a bottom perspective view of a recline base in accordance with an illustrative embodiment of the present disclosure.
Figure 15:
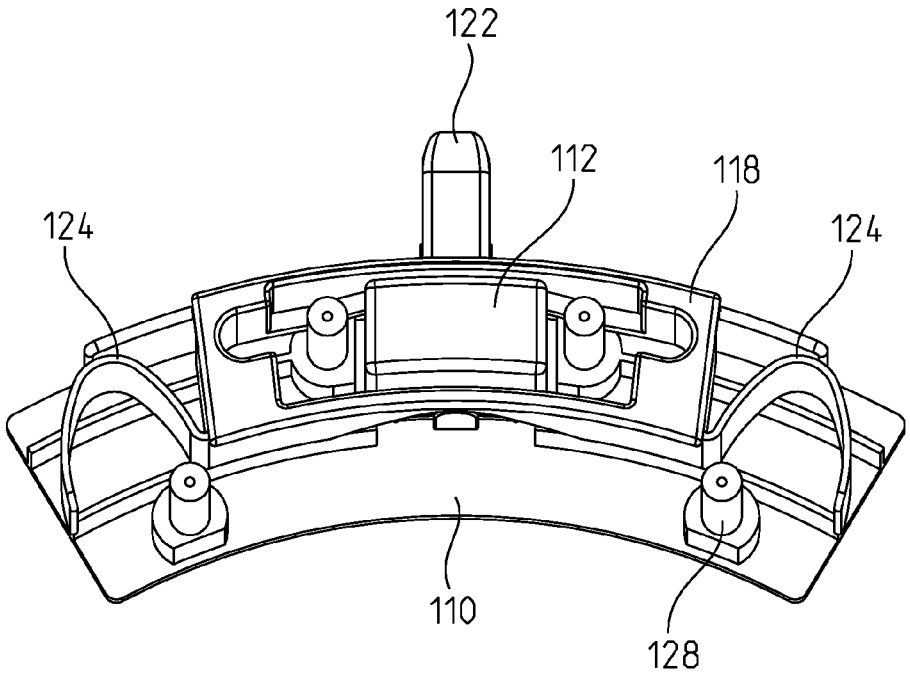
FIG. 15 is a top perspective view of a swivel latch mechanism in accordance with an illustrative embodiment of the present disclosure.
Figure 16:
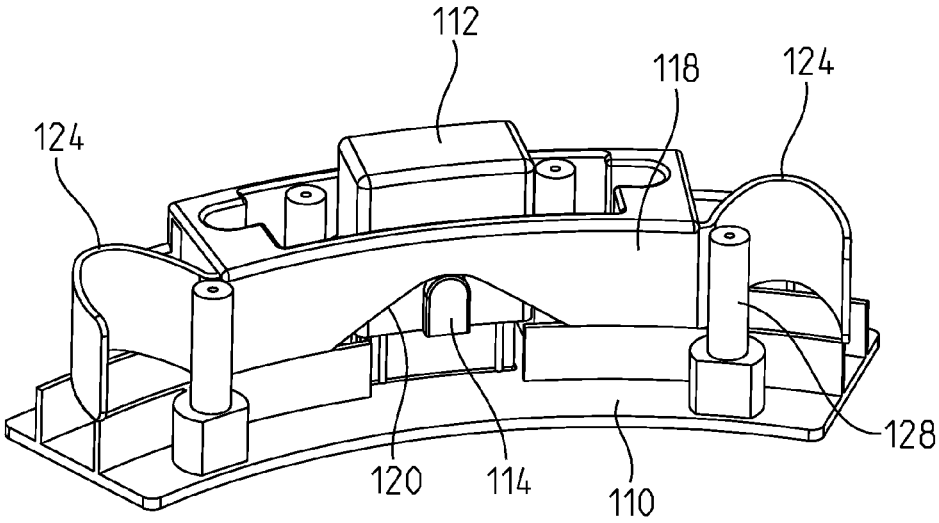
FIG. 16 is a rear perspective view of the swivel latch mechanism of FIG. 15.
Figure 17:
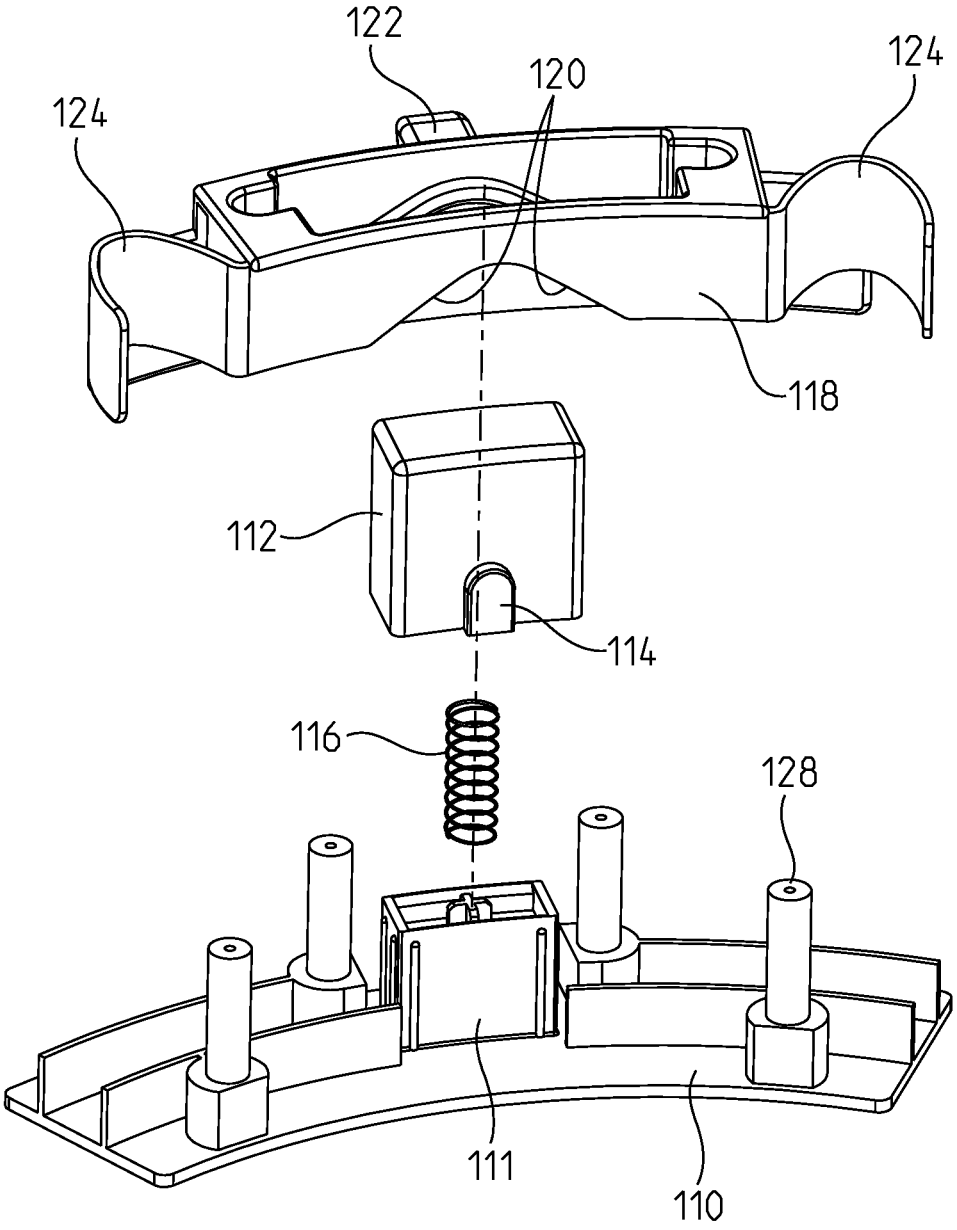
FIG. 17 is a rear exploded perspective view of the swivel latch mechanism of FIG. 15.

Roller 104 of swivel assembly 18 is coupled beneath recline base 70, as shown in FIG. 14. According to an exemplary embodiment of the present disclosure, wheels 106 are able to rotate relative to roller 104 to enable roller 104 to slide across annular track 108, but wheels 106 are prevented from translating freely relative to roller 104.

In use, roller 104 travels across annular track 108 to rotate recline base 70 and seat assembly 12 coupled thereto about a vertical axis relative to swivel base 100. By operating swivel assembly 18, seat assembly 12 may be positioned forward to face a dining table, or seat assembly 12 may be rotated side to side to face a caregiver seated in an adjacent dining chair, for example.

Referring next to FIGS. 14-17, swivel assembly 18 includes a swivel latch mechanism to adjust and control the position of seat assembly 12 relative to swivel assembly 18. An exemplary swivel latch mechanism is normally biased in a locked position to prevent movement of seat assembly 12, but may be unlocked when a user desires to rotate seat assembly 12. For example, an exemplary swivel latch mechanism of swivel assembly 18 may include frame 110 having guide 111, stopper 112 having protrusion 114, spring 116, and latch 118 having ramped engagement surfaces 120, handle 122, and return springs 124. The underside of recline base 70 may include multiple pockets 126 sized to receive stopper 112.

Figure 19:
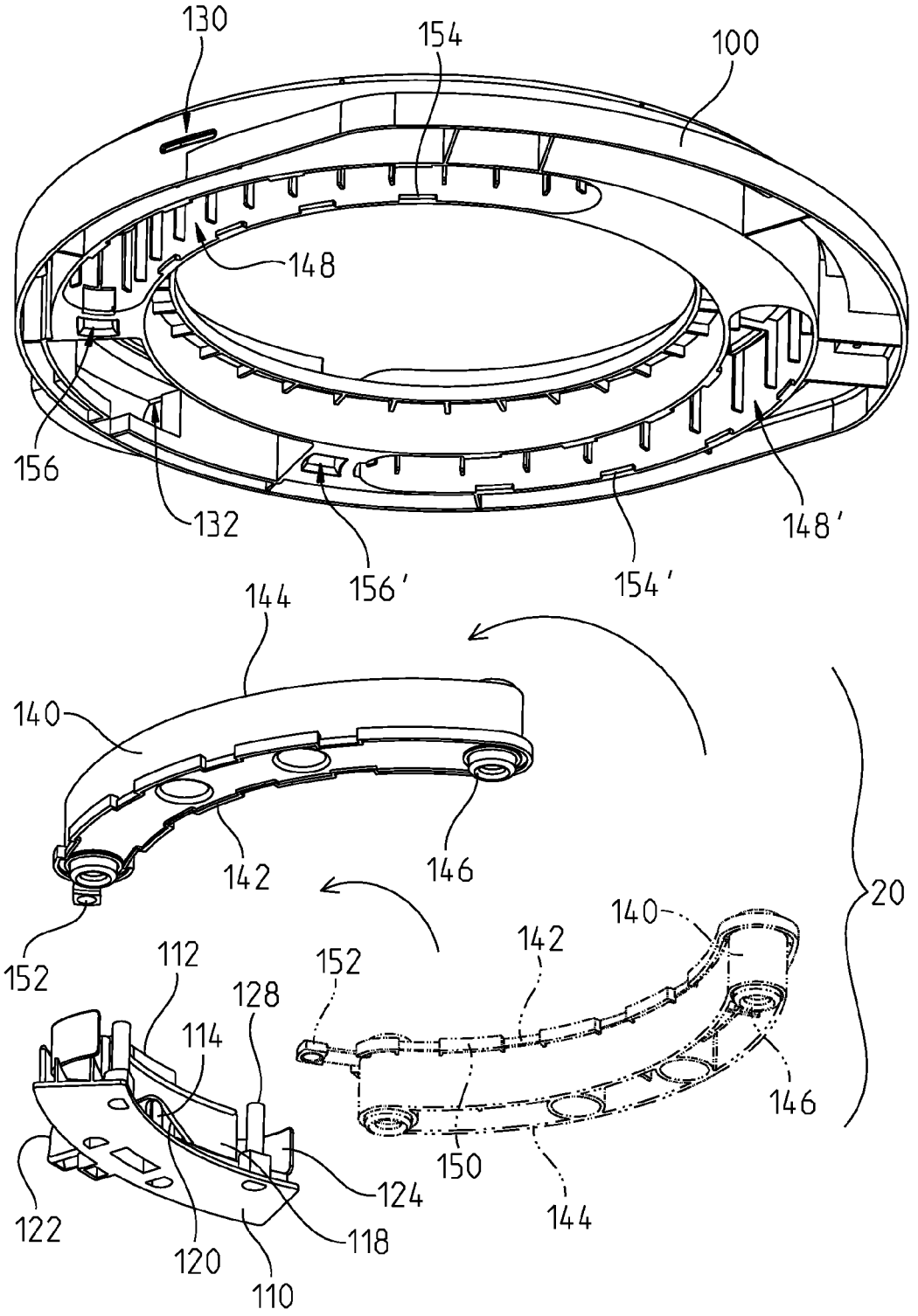
FIG. 19 is a bottom, rear exploded perspective view of the lift assembly of FIG. 18.

As shown in FIGS. 18-19, frame 110 may be received within chamber 132 of swivel base 100. To secure frame 110 to swivel base 100, frame 110 may include posts 128 that extend from frame 110 and through openings 134 in swivel base 100. During assembly, posts 128 of frame 110 may be heat-staked within openings 134.

In use, spring 116 normally biases stopper 112 upward to project beyond swivel base 100 and into a corresponding pocket 126 in recline base 70. In this locked position, recline assembly 16 and seat assembly 12 coupled to recline assembly 16 are prevented from rotating relative to swivel assembly 18. To rotate seat assembly 12, a user slides handle 122 of latch 118 to either side, causing the corresponding, downward-sloping, ramped engagement surface 120 of latch 118 to travel across protrusion 114 of stopper 112 and, as a result, forcing stopper 112 downward over guide 111 and out of engagement with recline base 70. When the user releases handle 122 of latch 118, the corresponding return spring 124 contacts a stationary structure, such as swivel base 100, to return latch 118 to the central starting position. As the now upward-sloping, ramped engagement surface 120 of latch 118 travels across protrusion 114 of stopper 112, spring 116 forces stopper 112 upward over guide 111 and back into locked engagement with recline base 70. The ability to slide latch 118 to either side may simplify the process of simultaneously pulling latch 118 and rotating seat assembly 12, especially if the person turning seat assembly 12 is seated to the side of seat assembly 12. However, it is also within the scope of the present disclosure that latch 118 may be configured to slide to only one side.

As shown in FIG. 14, the number of pockets 126 in recline base 70 determines the number of possible swivel positions for seat assembly 12. In the illustrated embodiment, recline base 70 includes seven pockets 126, so seat assembly 12 may be rotated to seven different positions relative to swivel base 100. Also, the arrangement of pockets 126 in recline base 70 determines the various angles to which seat assembly 12 may be rotated. In the illustrated embodiment, pockets 126 are evenly spaced around half of recline base 70, so seat assembly 12 may be positioned in a forward position (0 degrees), rotated approximately 30 degrees, 60 degrees, and 90 degrees to the left, and rotated approximately 30 degrees, 60 degrees, and 90 degrees to the right.

Referring back to FIGS. 1-4, swivel base 100 of feeding seat 10 may be placed directly upon the seat of a standard dining chair or another suitable horizontal surface. The size of swivel base 100 may be selected to accommodate a variety of standard dining chairs. For example, swivel base 100 may have a width and a depth less than approximately 18 inches. Swivel base 100 may include any number of slots 130 configured to receive straps (not shown) for securing feeding seat 10 to the dining chair. Swivel base 100 may also include grips 146, such as rubber grips, to resist slippage of feeding seat 10 and to prevent feeding seat 10 from scratching a dining chair.

Figure 18A:
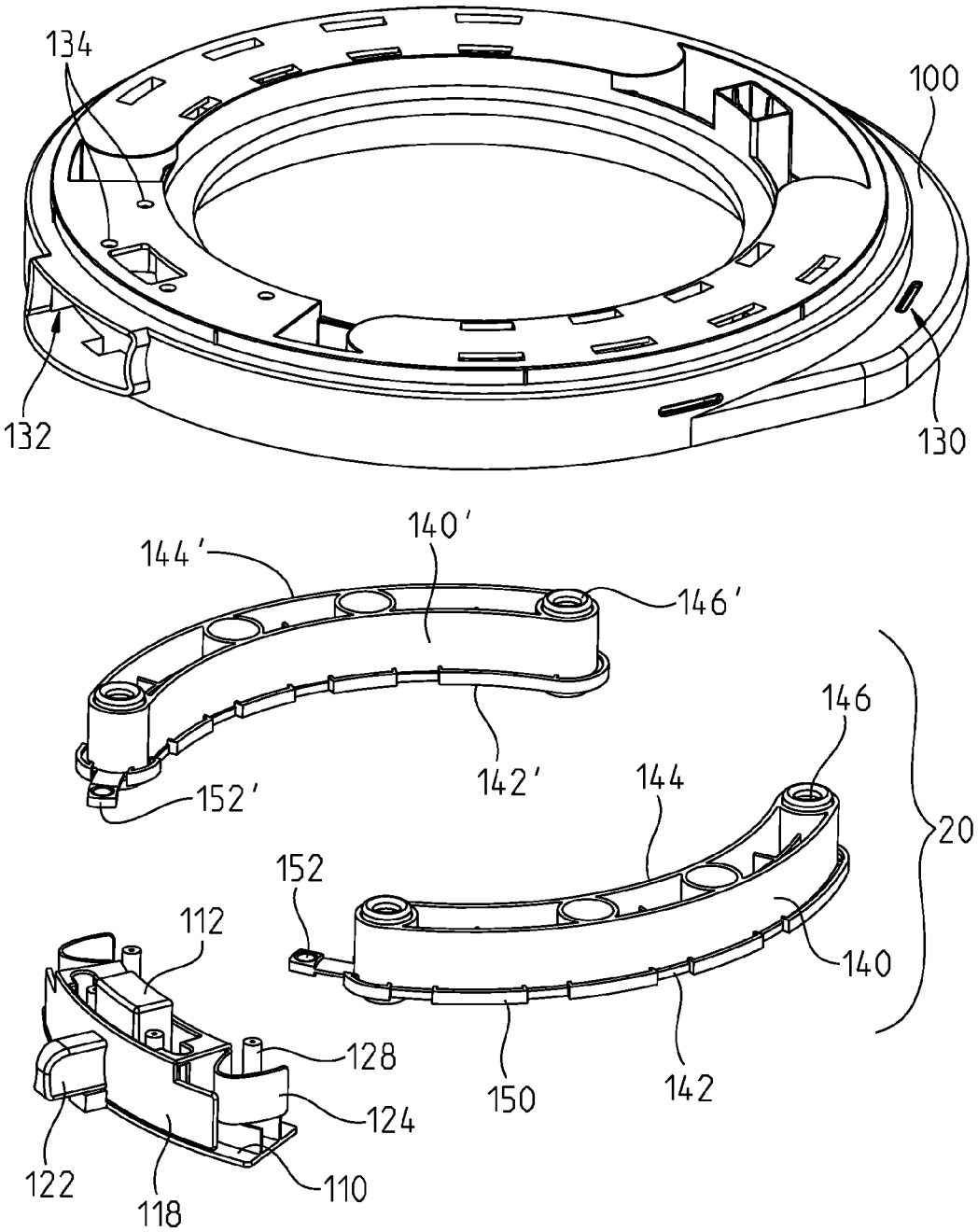
FIG. 18A is a top, front exploded perspective view of the lift assembly of FIG. 18, showing the riser of FIG. 17 in the raised position and a second riser in the raised position.

Referring next to FIGS. 18-23, lift assembly 20 is provided to adjust the height of seat assembly 12. As shown in FIG. 18A, lift assembly 20 includes a plurality of risers, including riser 140 and riser 140' that is a mirror-image of riser 140. An exemplary riser 140 has an elongate, arcuate shape and includes lower end 142 and upper end 144. Both lower end 142 and upper end 144 may include grips 146, such as rubber grips, to resist slippage of feeding seat 10 and to prevent feeding seat 10 from scratching a dining chair.

In use, risers 140, 140', may be attached to the underside of swivel base 100 to raise and lower swivel base 100 and seat assembly 12 coupled to swivel base 100. In a lowered position, risers 140, 140', may be stored substantially within swivel base 100. For example, as shown on the right side of FIG. 23, upper end 144 of riser 140 projects upwardly into swivel base 100. Lower end 142 of riser 140 may extend substantially evenly with the underside of swivel base 100, such that both lower end 142 of riser 140 and swivel base 100 rest upon a dining chair. In a raised position, risers 140, 140', may extend from swivel base 100 to a greater extent than in the lowered position. For example, as shown on the left side of FIG. 23, upper end 144 of riser 140 projects downwardly beyond swivel base 100, such that upper end 144 of riser 140 may rest upon a dining chair seat and swivel base 100 may be elevated above the dining chair. Lower end 142 of riser 140 may be received within swivel base 100 in this raised position.

Figure 20:
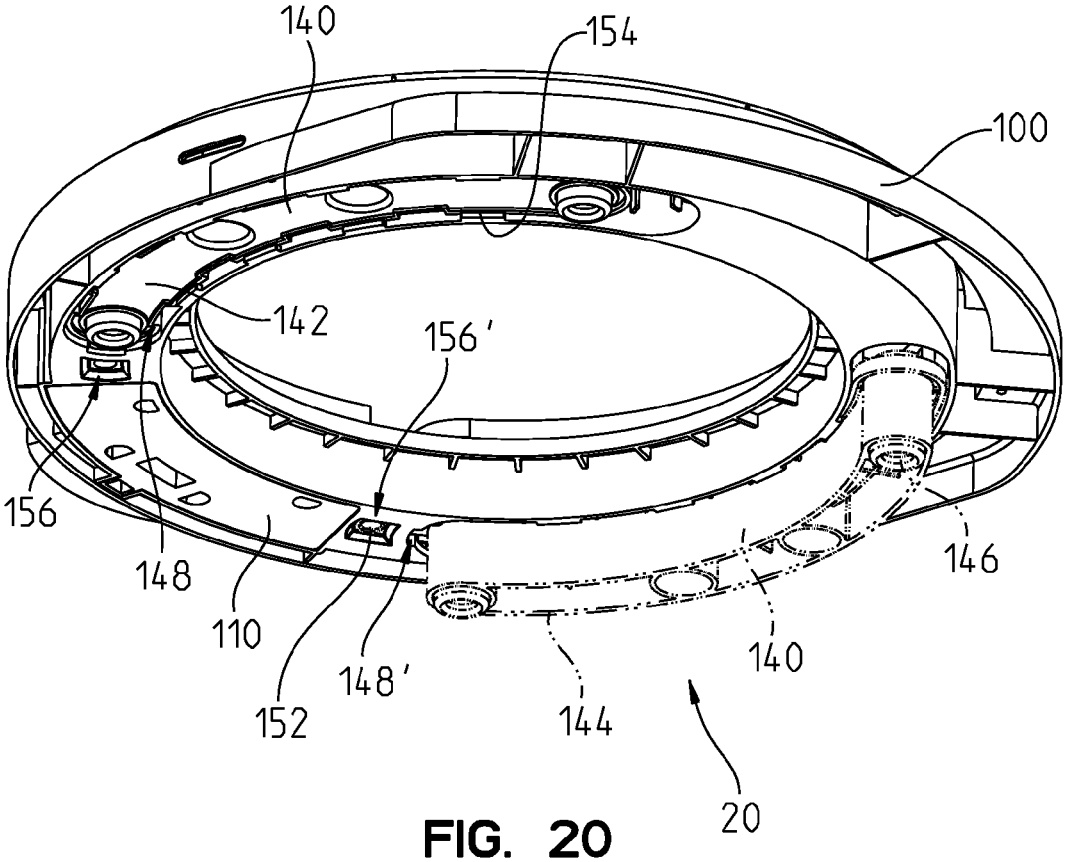
FIG. 20 is a bottom, rear perspective view of the lift assembly of FIG. 18.

As shown in FIGS. 18-20, swivel base 100 includes a plurality of openings 148, 148', sized to receive risers 140, 140'. In the illustrated embodiment, swivel base 100 includes opening 148 and opening 148' that is a mirror-image of opening 148. In the lowered position, riser 140 is inserted into opening 148 of swivel base 100, as shown on the left side of FIG. 20, and riser 140' is inserted into opening 148' of swivel base 100. In the raised position, risers 140, 140', are flipped 180 degrees and inserted into the other opening 148', 148. Specifically, riser 140 is flipped over and inserted into opening 148' of swivel base 100, as shown on the right side of FIG. 20, and riser 140' is flipped over and inserted into opening 148 of swivel base 100.

Figure 21:
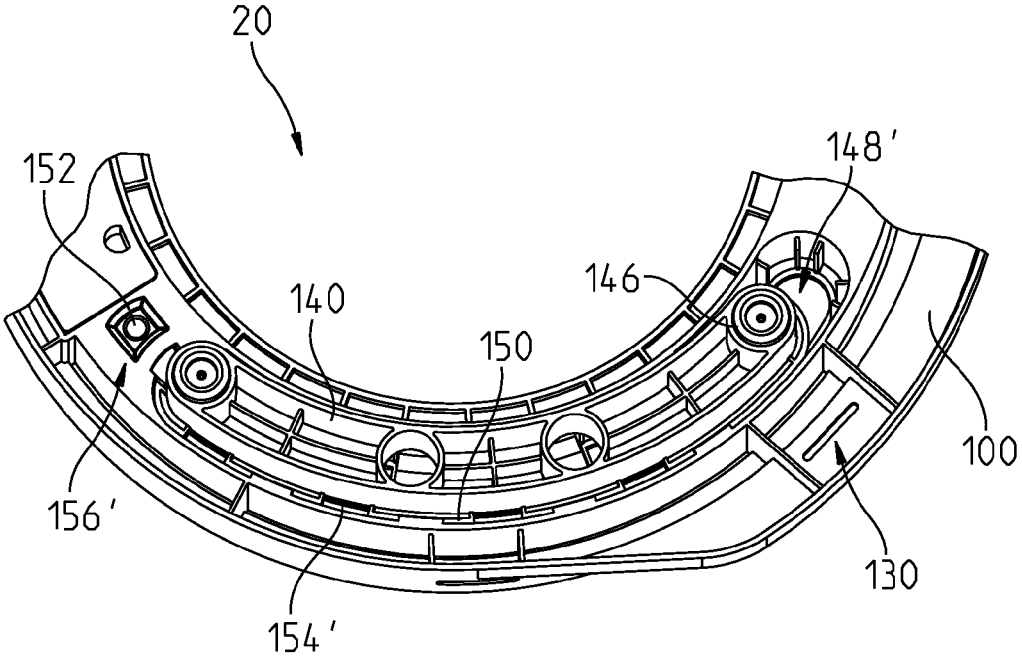
FIG. 21 is a bottom plan view of the lift assembly of FIG. 18, showing a riser in an engaged position.
Figure 22:
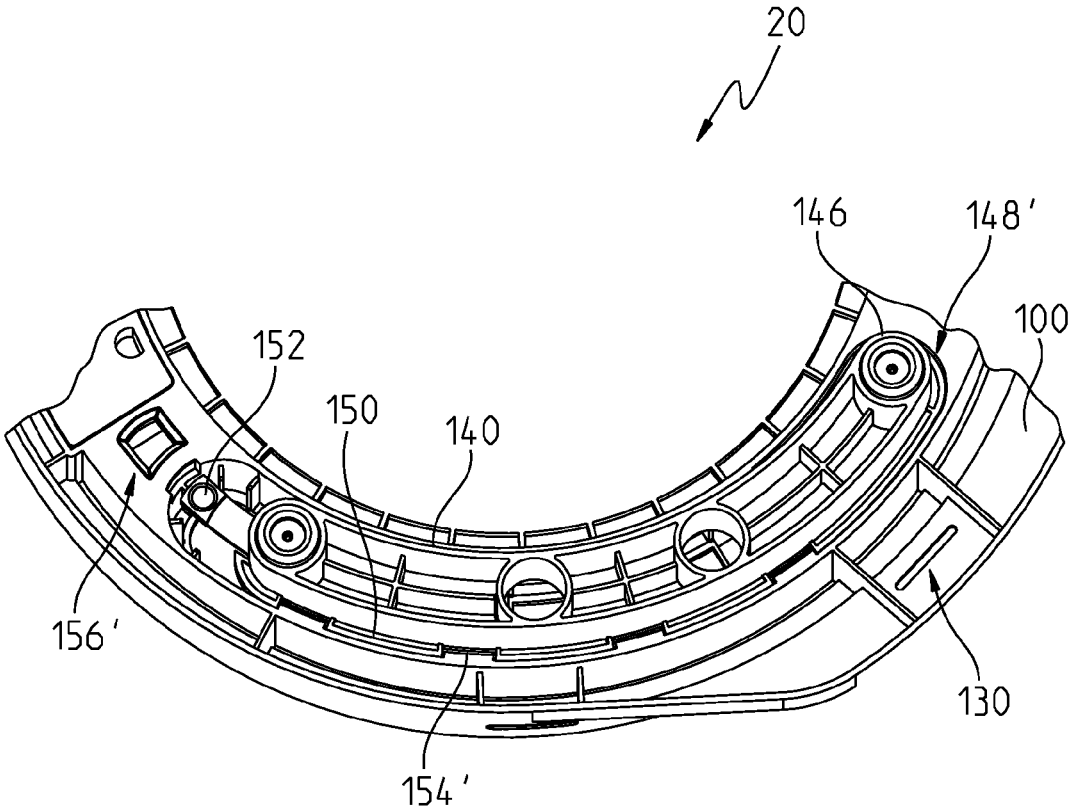
FIG. 22 is a bottom plan view of the lift assembly of FIG. 18, showing a riser in a disengaged position.

As shown in FIGS. 21 and 22, risers 140, 140', may be secured to swivel base 100 using suitable interconnecting features. In the illustrated embodiment, each riser 140, 140', includes a plurality of flanges 150, 150', spaced about the periphery of riser 140, 140', at a location closer to lower end 142, 142', than upper end 144, 144', of riser 140, 140', and snap 152, 152'. Each opening 148, 148', of swivel base 100 includes a plurality of spaced lips 154, 154', that project into openings 148, 148', and aperture 156'.

To secure riser 140 within opening 148' of swivel base 100, for example, the user first inserts riser 140 into opening 148' with flanges 150 of riser 140 extending between adjacent lips 154' of swivel base 100, as shown in FIG. 22. Then, the user slides riser 140 toward aperture 156' until flanges 150 of riser 140 are aligned with lips 154' of swivel base 100 and snap 152 of riser 140 snaps into aperture 156' of swivel base 100, as shown in FIG. 21. When swivel base 100 is positioned upright for use, lips 154' project beneath riser 140 to support riser 140 and to prevent riser 140 from falling out of swivel base 100.

To remove riser 140 from opening 148' of swivel base 100, the user presses snap 152 of riser 140 through aperture 156' to disengage snap 152. Then, the user slides riser 140 away from aperture 156' to free flanges 150 of riser 140 from lips 154' of swivel base 100.

Although the processes for securing and removing risers 140, 140', are described above with reference to riser 140 and opening 148' of swivel base 100, in particular, similar processes are performed to position each riser 140, 140', within either opening 148, 148', of swivel base 100.

Figure 23:
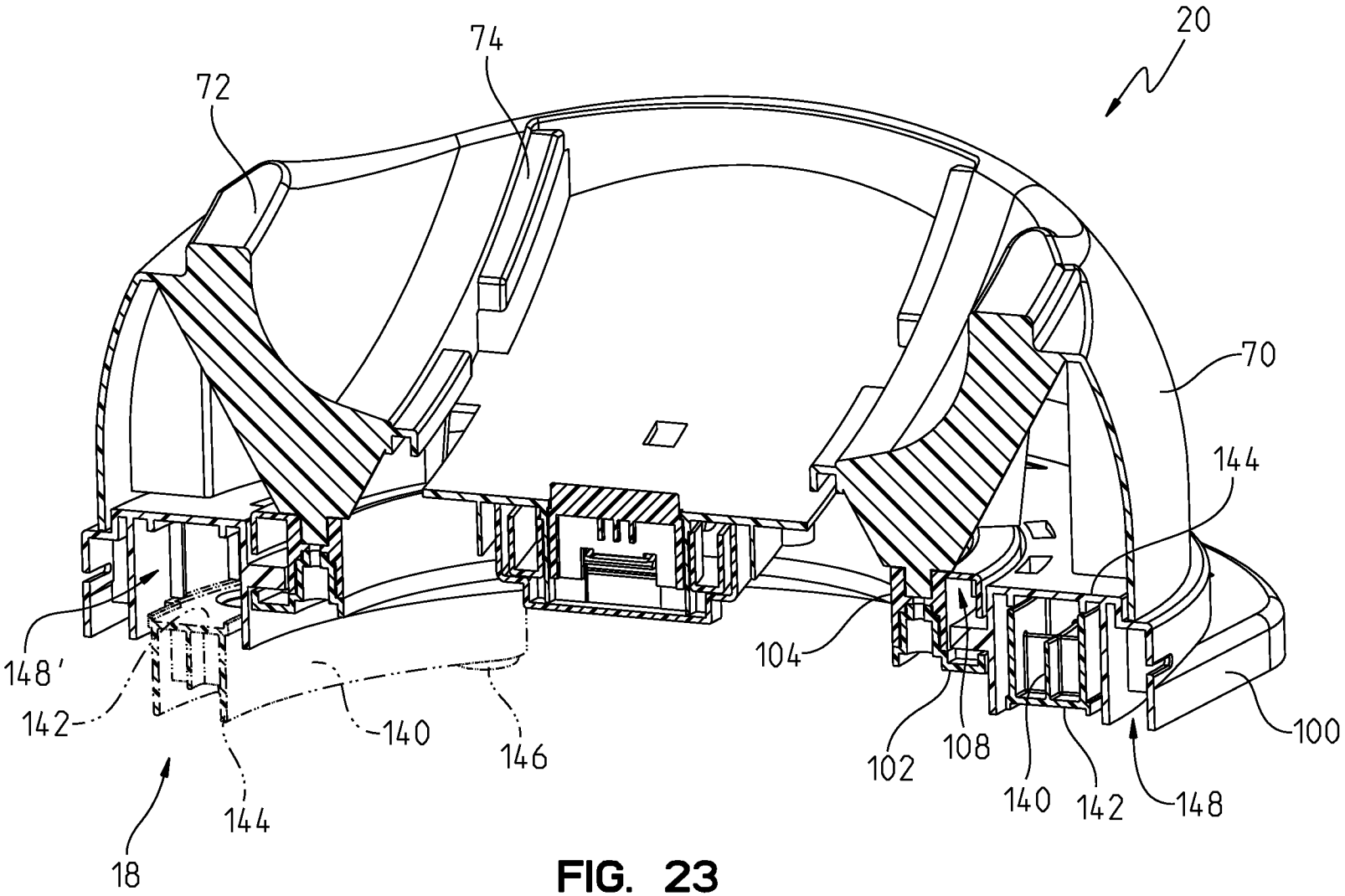
FIG. 23 is a cross-sectional perspective view of a lift assembly and swivel assembly in accordance with another illustrative embodiment of the present disclosure, showing a riser in a raised position and a lowered position.

As shown in FIG. 23, the thickness of riser 140, or the distance between lower end 142 and upper end 144 of riser 140, determines the raised height of seat assembly 12. For example, seat assembly 12 may be raised by a distance of approximately 1 inch, 2 inches, or more.

Feeding seat 10 may include other optional features. For example, feeding seat 10 may include a removable pad (not shown) to cushion seat assembly 12. The pad may be constructed of a durable, stain-resistant material, such as vinyl. As another example, feeding seat 10 may include a toy-carrying bar (not shown) for entertaining and stimulating small children.

While this invention has been described as having exemplary designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A child's seat assembly comprising:

a seat having a top surface that is contoured to support a child in a seated position and a bottom surface;

a tray coupled to the seat;

a swivel base that supports the seat, the seat being rotatable relative to the swivel base about a vertical axis;

a recline base positioned between the seat and the swivel base, the seat configured to recline relative to the recline base and the recline base configured to rotate relative to the swivel base; and a swivel lock mechanism that selectively locks the seat in at least a first, forward-facing position, a second, right-facing position, and a third, left-facing position relative to the swivel base, the swivel lock mechanism including a stopper biased vertically upwards and arcuate return springs extending from sides of a latch body, the stopper received in pockets defined by the recline base.

2. The child's seat assembly of claim 1, wherein the swivel lock mechanism includes:

a handle slidably coupled to the swivel base, the handle defining at least one ramped engagement surface;

a stopper moveably coupled to the swivel base; and a biasing member that forces the stopper toward the seat;

wherein the swivel lock mechanism is adjustable between a locked position, in which the stopper prevents the seat from rotating relative to the swivel base, and an unlocked position, in which the seat is able to rotate relative to the swivel base, by sliding the at least one ramped engagement surface of the handle over the stopper to move the stopper relative to the seat.

3. The child's seat assembly of claim 2, wherein the handle is slidable relative to the swivel base in a first direction to a first unlocked position and in a second direction opposite the first direction to a second unlocked position, the handle being biased in the locked position between the first and second unlocked positions.

4. The child's seat assembly of claim 1, further comprising a roller assembly coupled to one of the seat and the swivel base, the roller assembly configured to roll across an annular track as the seat rotates relative to the swivel base.

5. The child's seat assembly of claim 1, further comprising at least one riser, the swivel base configured to engage the at least one riser in a first, lowered position and a second, raised position, the at least one riser being rotated 180 degrees from the lowered position to the raised position, the at least one riser projecting further beyond the swivel base in the raised position than in the lowered position.

6. The child's seat assembly of claim 1, further comprising a first riser and a second riser, wherein the swivel base defines a first aperture and a second aperture, the child's seat assembly adjustable between a lowered position in which the first riser is stored within the first aperture and the second riser is stored within the second aperture, and a raised position in which the first riser projects beyond the swivel base from the second aperture and the second riser projects beyond the swivel base from the first aperture, the seat being positioned higher in the raised position than in the lowered position.

7. A child's seat assembly comprising:

a seat having a top surface that is contoured to support a child in a seated position and an arcuate bottom surface;

a tray coupled to the seat;

a base that defines an arcuate platform for supporting the arcuate bottom surface of the seat as the seat reclines and inclines relative to the base, the seat including a first coupling member and the base including a second coupling member, the first and second coupling members engaging to couple the seat onto the base, the seat being removable from the base by reclining or inclining the seat relative to the base until the first and second coupling members are disengaged;

a recline lock mechanism that selectively locks the seat from reclining and inclining relative to the base; and a recline stop mechanism independent of the recline lock mechanism, the recline stop mechanism including a first stop surface on the base and a second stop surface on the seat that abuts the first stop surface on the base when the seat reaches a fully reclined position relative to the base, and wherein the seat includes a moveable release tab that transmits movement to the second stop surface of the seat to separate the second stop surface of the seat from the first stop surface of the base.

8. The child's seat assembly of claim 7, wherein the first coupling member includes one of a groove and a tongue and the second coupling member includes the other of the groove and the tongue, the tongue sized to slide within the groove as the seat reclines and inclines relative to the base, the groove having at least one open end, the seat being removable from the base by reclining or inclining the seat relative to the base until the tongue exits the at least one open end of the groove.

9. The child's seat assembly of claim 8, wherein the groove defines an arcuate path for the tongue.

10. The child's seat assembly of claim 8, wherein the tongue is arcuate in shape.

11. The child's seat assembly of claim 8, wherein the groove and the tongue are located above the arcuate platform of the base.

12. The child's seat assembly of claim 8, wherein the base includes at least one guide rail that projects from the base at a location above the arcuate platform, the at least one guide rail cooperating with the arcuate platform to define the groove in the base, the tongue extending from the seat to cooperate with the groove in the base.

13. The child's seat assembly of claim 12, wherein the at least one guide rail extends above the tongue to prevent the seat from being lifted off of the base.

14. The child's seat assembly of claim 12, wherein the tongue extends outwardly from the arcuate bottom surface of the seat.

15. The child's seat assembly of claim 7, wherein the recline lock mechanism includes:

a handle slidably coupled to the base, the handle defining a ramped engagement surface;

a stopper moveably coupled to the base; and a biasing member that forces the stopper toward the seat;

wherein the recline lock mechanism is adjustable between a locked position, in which the stopper engages the seat to prevent the seat from reclining relative to the base, and an unlocked position, in which the stopper disengages the seat to enable the seat to recline relative to the base, by sliding the ramped engagement surface of the handle over the stopper to move the stopper relative to the seat.

16. The child's seat assembly of claim 15, wherein sliding the handle in a first direction relative to the base causes the stopper to move in a second direction relative to the base that is substantially perpendicular to the first direction.

17. A child's seat assembly configured to rest on a supporting surface, the child's seat assembly comprising:

a base having an underside that faces that supporting surface;

a seat supported by the base, the seat configured to recline relative to the base, the seat having a top surface that is contoured to support a child in a seated position;

a tray coupled to the seat; and at least one riser that is rotatable relative to the base to position the seat in a first, lowered position relative to the supporting surface and a second, raised position relative to the supporting surface wherein the base is lifted entirely away from contact with the supporting surface, the at least one riser projecting further beyond the base in the raised position than in the lowered position, the at least one riser having a first surface and a second surface opposite the first surface, the first surface of the at least one riser facing upward toward the seat in the lowered position and downward toward the supporting surface in the raised position, the at least one riser being stored within the base in the lowered position with the second surface of the at least one riser being substantially even with the underside of the base in the lowered position, the riser including an interlocking connection to lockingly connect the riser to the base to prevent withdrawal of the riser without disengaging the interlocking connection, the connection being locked by moving the riser relative to the base.

18. The child's seat assembly of claim 17, wherein the at least one riser rotates 180 degrees from the lowered position to the raised position.

19. The child's seat assembly of claim 17, wherein the second surface of the at least one riser faces downward toward the supporting surface in the lowered position and upward toward the seat in the raised position, and wherein the interlocking connection includes lips on the base and flanges on the riser.

20. The child's seat assembly of claim 19, wherein both the first and second surfaces of the at least one riser include grips, the grips on the first surface contacting the supporting surface in the raised position, and the grips on the second surface contacting the supporting surface in the lowered position, and the interlocking connection further includes an extension on the riser that snap locks into an aperture in the base.

21. The child's seat assembly of claim 20, wherein the seat reclines relative to the base independently of the at least one riser, and the interlocking connection is engaged by horizontally sliding the riser relative to the base, and is disengaged by depressing the extension and sliding the riser in the opposite direction.

* * * * *